US006009299A

United States Patent [19]

Ishihara et al.

[11] Patent Number: 6,009,299

[45] Date of Patent: Dec. 28, 1999

[54] ELECTROPHOTOGRAPHIC IMAGING APPARATUS USING MULTI-LAYERED TONER

[75] Inventors: Toru Ishihara; Masamitsu Nagamine; Koichi Matsuzaki; Kuniharu Hayashi, all of Tokyo, Japan

[73] Assignee: Oki Data Corporation, Tokyo, Japan

[21] Appl. No.: 09/224,298

[22] Filed: Dec. 31, 1998

[30] Foreign Application Priority Data

Jan. 8, 1998 [JP] Japan ..... 10-002466
Feb. 25, 1998 [JP] Japan ..... 10-060499

[51] Int. Cl.[6] ..... G03G 15/20; G03G 9/00

[52] U.S. Cl. ..... 399/324; 399/252; 430/109

[58] Field of Search ..... 399/252, 265, 399/274, 279, 324, 328; 430/109, 110, 111

[56] References Cited

U.S. PATENT DOCUMENTS 5,330,871 7/1994 Tanikawa et al. ..... 430/110
5,766,814 6/1998 Baba et al. ..... 430/106.6
5,830,617 11/1998 Koyama et al. ..... 430/109

*Primary Examiner*—William Royer
*Assistant Examiner*—Hoang Ngo
*Attorney, Agent, or Firm*—Rabin & Champagne, PC

[57] ABSTRACT

A developing roller rotates in contact with a photoreceptor drum. The developing roller controls a development thorough the formation of a toner layer 50 $\mu$m or less in thickness on an outer surface. The photoreceptor drum transfers a toner image formed on the outer surface by the controlled-development onto a medium. A fixation device heat-treats and fixes the toner image transferred onto the medium. A toner for the developing treatment comprises a resin having a Tg of 75° C. or more as at least part of it.

5 Claims, 12 Drawing Sheets

*Fig. 5* glass transition temperature of shell

| layer thickness (μm) | pressure (g/cm) | 85 | 80 | 75 | 70 | 65 | 60 | 50 | 40 |
|---|---|---|---|---|---|---|---|---|---|
| 7 | 10 | ◎ | ◎ | ◎ | × | × | × | × | × |
| 10 | 5 | ◎ | ◎ | ◎ | × | × | × | × | × |
| 12 | 4 | ◎ | ◎ | ◎ | × | × | × | × | × |
| 20 | 1.5 | ◎ | ◎ | ◎ | × | × | × | × | × |
| 25 | 1 | ◎ | ◎ | ◎ | × | × | × | × | × |
| 30 | 0.5 | ◎ | ◎ | ◎ | × | × | × | × | × |
| 40 | 0.4 | ◎ | ◎ | ◎ | × | × | × | × | × |
| 50 | 0.3 | ◎ | ◎ | ◎ | × | × | × | × | × |
| 60 | 0.2 | ◎ | ◎ | ◎ | ◎ | ◎ | ◎ | ◎ | × |
| 70 | 0.1 | ◎ | ◎ | ◎ | ◎ | ◎ | ◎ | ◎ | × |

*Fig. 6* glass transition temperature of shell

| layer thickness (μm) | pressure (g/cm) | 85 | 80 | 75 | 70 | 65 | 60 | 50 | 40 |
|---|---|---|---|---|---|---|---|---|---|
| 7 | 10 | ◎ | ◎ | ◎ | --- | --- | --- | --- | --- |
| 10 | 5 | ◎ | ◎ | ◎ | --- | --- | --- | --- | --- |
| 12 | 4 | ◎ | ◎ | ◎ | --- | --- | --- | --- | --- |
| 20 | 1.5 | ◎ | ◎ | ◎ | --- | --- | --- | --- | --- |
| 25 | 1 | ◎ | ◎ | ◎ | --- | --- | --- | --- | --- |
| 30 | 0.5 | ◎ | ◎ | ◎ | --- | --- | --- | --- | --- |
| 40 | 0.4 | ◎ | ◎ | ◎ | --- | --- | --- | --- | --- |
| 50 | 0.3 | ◎ | ◎ | ◎ | --- | --- | --- | --- | --- |
| 60 | 0.2 | ◎ | ◎ | ◎ | ◎ | ◎ | ◎ | ◎ | --- |
| 70 | 0.1 | ◎ | ◎ | ◎ | ◎ | ◎ | ◎ | ◎ | --- |

◎ no change

× aggregation

Fig. 9 glass transition temperature of shell

| pushing pressure (g/mm) | 85 | 80 | 75 | 70 | 65 | 60 | 50 | 40 |
|---|---|---|---|---|---|---|---|---|
| 40 | ◎ | ◎ | ◎ | × | × | × | × | × |
| 35 | ◎ | ◎ | ◎ | × | × | × | × | × |
| 30 | ◎ | ◎ | ◎ | × | × | × | × | × |
| 25 | ◎ | ◎ | ◎ | × | × | × | × | × |
| 20 | ◎ | ◎ | ◎ | × | × | × | × | × |
| 15 | ◎ | ◎ | ◎ | × | × | × | × | × |
| 10 | ◎ | ◎ | ◎ | × | × | × | × | × |
| 5 | ◎ | ◎ | ◎ | × | × | × | × | × |
| 2 | ◎ | ◎ | ◎ | × | × | × | × | × |
| 1.5 | ◎ | ◎ | ◎ | ◎ | × | × | × | × |
| 1 | ◎ | ◎ | ◎ | ◎ | ◎ | × | × | × |
| 0.5 | ◎ | ◎ | ◎ | ◎ | ◎ | ◎ | × | × |
| 0.2 | ◎ | ◎ | ◎ | ◎ | ◎ | ◎ | ◎ | × |

*Fig. 10* glass transition temperature of shell

| pushing pressure (g／mm) | 85 | 80 | 75 | 70 | 65 | 60 | 50 | 40 |
|---|---|---|---|---|---|---|---|---|
| 40 | ◎ | ◎ | ◎ | --- | --- | --- | --- | --- |
| 35 | ◎ | ◎ | ◎ | --- | --- | --- | --- | --- |
| 30 | ◎ | ◎ | ◎ | --- | --- | --- | --- | --- |
| 25 | ◎ | ◎ | ◎ | --- | --- | --- | --- | --- |
| 20 | ◎ | ◎ | ◎ | --- | --- | --- | --- | --- |
| 15 | ◎ | ◎ | ◎ | --- | --- | --- | --- | --- |
| 10 | ◎ | ◎ | ◎ | --- | --- | --- | --- | --- |
| 5 | ◎ | ◎ | ◎ | --- | --- | --- | --- | --- |
| 2 | ◎ | ◎ | ◎ | --- | --- | --- | --- | --- |
| 1.5 | ◎ | ◎ | ◎ | ◎ | --- | --- | --- | --- |
| 1 | ◎ | ◎ | ◎ | ◎ | ◎ | --- | --- | --- |
| 0.5 | ◎ | ◎ | ◎ | ◎ | ◎ | ◎ | --- | --- |
| 0.2 | ◎ | ◎ | ◎ | ◎ | ◎ | ◎ | ◎ | --- |

◎ no change

× aggregation

Fig. 12

| shell / core | absence | 45 | 55 | 65 | 75 | 85 | 90 | 100 |
|---|---|---|---|---|---|---|---|---|
| 35 | presence | presence | presence | presence | absence | absence | absence | absence |
| 45 | presence | ----- | presence | presence | absence | absence | absence | absence |
| 55 | presence | ----- | ----- | presence | absence | absence | absence | absence |
| 65 | absence | ----- | ----- | ----- | absence | absence | absence | absence |
| 75 | absence | ----- | ----- | ----- | ----- | absence | absence | absence |

Fig. 13

| shell / core | absence | 45 | 55 | 65 | 75 | 85 | 90 | 100 |
|---|---|---|---|---|---|---|---|---|
| 35 | × | × | △ | ○ | absence | absence | absence | absence |
| 45 | × | ----- | △ | ○ | absence | absence | absence | absence |
| 55 | △ | ----- | ----- | ○ | absence | absence | absence | absence |
| 65 | ○ | ----- | ----- | ----- | absence | absence | absence | absence |
| 75 | ○ | ----- | ----- | ----- | ----- | absence | absence | absence |

ELECTROPHOTOGRAPHIC IMAGING APPARATUS USING MULTI-LAYERED TONER

DESCRIPTION OF THE RELATED ART

Conventional electrophotographic imaging methods comprise the steps of uniformly electrifying a photoconductive insulating layer which is placed on a outer surface of a photoreceptor drum, then exposing the layer to light, and partially dissipating the charge on the exposed portion to form an electrostatic latent image. It further requires a developing step in which a developing agent comprising at least a coloring agent (referred to as a toner hereinafter) deposits to the latent image to form a toner image; a transferring step in which the resultant toner image is transferred onto a medium such as paper; and a fixing step in which the image is fixed by suitable fixing methods such as heating, pressure, and the like.

The toner used in these apparatuses is susceptible to various mechanical damages such as heat, friction, contact, and the like due to an agitation in a developing device, so that the performance of the toner deteriorates easily.

More specifically, after a toner softens in a developing device due to heat caused by elevated temperature inside of the device, it deposits onto a toner layer-forming member (referred to as a developing blade hereinafter), a developing agent carrier (referred to as a developing roller hereinafter), a toner-supplying roller, and the like, and these deposits may cause some problems.

A phenomenon that a toner deposits to an outer surface of a developing roller to form a film-like layer is called "filming phenomenon".

Then the toner held in the developing device for a long time deteriorates, since it suffers from a mechanical stress caused by a developing blade, a developing roller, a toner-supplying roller and so on. Thus it becomes difficult to maintain the performance as a developing agent until the life limit of an EP cartridge, which is a unit for printing which can be replaced withheld toner.

Additionally, in a contact developing system characterized in a developing roller that contacts with a photoreceptor drum and developing, the developing drum contacts with the photoreceptor drum at a high pressure. Hence, when the EP cartridge is left under a high temperature condition or for a long time, the toner sandwiched between the photoreceptor drum and the developing roller adheres to the photoreceptor drum (or the developing roller, or both) after the toner is deformed by pressure of the contact area, and likely causes a poor printing quality.

As a method for preventing the mechanical damage of toner, the following attempt is made. In order to decrease the mechanical stress on the toner generated between the developing roller and the toner, an attempt to use soft material like a belt instead of the developing roller has been made.

Otherwise, in order to decrease the stress on the toner, a reduction in the pressure of the developing blade on the developing roller is attempted.

On the other hand, the fixation device accommodated in the apparatus with the developing device generates a large amount of heat. This heat results in thermal damage to the toner. A waste-heat fan equipped to the apparatus is useful to prevent thermal damage to the toner held in the developing device, but this causes noise problems, and could impair the silent running that is an advantage of the electrophotography. And it creates a bottleneck in cost or miniaturization of the apparatus.

On the contrary, it has been attempted to make a toner having an easy fixing property to decrease heat generated by the fixation device.

To give an example, a capsulated toner, i.e., a so-called a low-temperature-fixing toner, has been proposed. The capsulated toner consists of a core and a shell that covers the surface of the core, and has a multilayer structure. A wax having a low melting point, such as a liquid wax and rubber-like wax at room temperature is used as a material of the core. And as a shell material, a material having a higher glass transition temperature than that of the core material is used to improve the storage stability at high temperatures.

SUMMARY OF THE INVENTION

However, an easier fixing toner has weaker mechanical properties. If the stress on the toner is relaxed, it becomes difficult to electrify the toner since the frictional force of the toner to the developing roller and the developing blades is weakened, resulting in poor printing quality.

Specifically, in this developing method, since the toner is frictionally electrified in the area where the developing roller and the photoreceptor drum contact, a decreased pushing-pressure leads to a decreased charge level of the toner. If the toner does not positively charge, the electrostatic latent image may not develop correctly, increasing a risk of fog, or a deterioration of reproductively of a dot or a line.

Thus, in the contact developing system, it is unavoidable to apply a certain pressure or more on the toner in the developing area. The object of this invention is to improve the capsulated toner.

It is therefore a principal object of the present invention to avoid the disadvantages of the prior art. therefore a principal object of the present invention to avoid the disadvantages of the prior art.

According to the first aspect of the invention, there is provided an imaging apparatus comprising:

a developing roller rotating in contact with a photoreceptor drum and controlling a development thorough the formation of a toner layer 50 $\mu$m or less in thickness on an outer surface;

a photoreceptor drum transferring a toner image formed on the outer surface by the controlled-development onto a medium;

a fixation device heat-treating and fixing the toner image transferred onto the medium; and a toner for the developing treatment comprising a resin having a Tg of 75° C. or more as at least part of it.

According to the second aspect of the invention, there is provided an imaging apparatus comprising:

a developing roller rotating in contact with a photoreceptor drum and controlling a development thorough the formation of a toner layer 50 $\mu$m or less in thickness on an outer surface;

a photoreceptor drum transferring a toner image formed on a outer surface by the controlled-development onto a medium;

a fixation device heat-treating and fixing the toner image transferred onto the medium; and a toner for the developing treatment placing a resin having a Tg of 75° C. or more on the outermost portion.

According to the third aspect of the invention, there is provided an imaging apparatus comprising:

a developing roller rotating in contact with a photoreceptor drum and controlling a development thorough the formation of a toner layer 50 μm or less in thickness on an outer surface;

a photoreceptor drum transferring a toner image formed on a outer surface by the controlled-development onto a medium;

a fixation device heat-treating and fixing the toner image transferred onto the medium; and a toner for the developing treatment disposing a resin having a Tg of 85° C. or more at the outermost portion.

According to the fourth aspect of the invention, there is provided an imaging apparatus comprising:

a developing roller rotating in contact with a photoreceptor drum at a pressure welding force from 2 g/mm to 30 g/mm and controlling a development thorough the formation of a toner layer 50 μm or less in thickness on an outer surface;

a photoreceptor drum transferring a toner image formed on a outer surface by the controlled-development onto a medium;

a fixation device heat-treating and fixing the toner image transferred onto the medium; and a toner for the developing treatment comprising a resin having a Tg of 75° C. or more as at least part of it.

According to the fifth aspect of the invention, there is provided an imaging apparatus comprising:

a developing roller rotating in contact with a photoreceptor drum at a pressure welding force from 2 g/mm to 30 g/mm and controlling a development thorough the formation of a toner layer 50 μm or less in thickness on an outer surface;

a photoreceptor drum transferring a toner image formed on a outer surface by the controlled-development onto a medium;

a fixation device heat-treating and fixing the toner image transferred onto the medium; and a toner for the developing treatment disposing a resin having a Tg of 75° C. or more at the outermost portion.

According to the sixth aspect of the invention, there is provided an imaging apparatus comprising:

a developing roller rotating in contact with a photoreceptor drum at a pressure welding force from 2 g/mm to 30 g/mm and controlling a development thorough the formation of a toner layer 50 μm or less in thickness on an outer surface;

a photoreceptor drum transferring a toner image formed on a outer surface by the controlled-development onto a medium;

a fixation device heat-treating and fixing the toner image transferred onto the medium; and a toner for the developing treatment disposing a resin having a Tg of 85° C. or more at the outermost portion.

In the preferred mode of any one of the preceding invention, wherein the toner comprises a thermoplastic resin and a coloring agent as constituent materials, and comprises two or more kinds of polymerizable monomers, having different Tg of resin after polymerization According to the seventh aspect of the invention, there is provided an imaging apparatus comprising:

a developing roller rotating in contact with a photoreceptor drum and controlling a development thorough the formation of a toner layer 50 μm or less in thickness on an outer surface;

a photoreceptor drum transferring a toner image formed on a outer surface by the controlled-development onto a medium;

a fixation device heat-treating and fixing the toner image transferred onto the medium, wherein a fixation-pressure is from 400 g/cm to 1400 g/cm in linear load; and a capsulated toner for the developing treatment disposing a shell resin having a Tg of 75° to 100° at the outermost portion.

BRIEF DESCRIPTION OF DRAWINGS

FIG. 5 illustrates the result of presence or absence of toner deposited on the surface of the developing roller.

FIG. 6 illustrates the results of toner fluidity remaining in the EP cartridge.

FIG. 9 illustrates the results of presence or absence of deposits of the toner on the surface of the developing roller.

FIG. 10 illustrates the results of toner fluidity remaining in the EP cartridge.

FIG. 12 illustrates the results of the durability test of the capsulated toner of the embodiment 3.

FIG. 13 illustrates the results of the shelf test at high temperature of the capsulated toner of the embodiment 3.

DESCRIPTION OF THE PREFERRED EMBODIMENTS

These inventors have found that the above-mentioned problems were solved when a developing agent which comprises a resin used in an electrophotographic imaging apparatus. The resin has the highest glass transition temperature, for example, 75° C. or more, preferably 85° C., among resins constituting the developing agent. The electrophotographic imaging apparatus uses a developing device in which the developing agent on a developing agent carrier, such as a developing roller, is 50 μm or less in thickness.

These inventors have also disclosed that such toner comprises resins which consists of two or more resins having different glass transition temperatures, and that it is very effective that these resins have a capsular structure.

Using such toner, the contact-pressure between the developing roller and the developing blade could be adjusted to a value that is necessary to obtain enough frictional charge level. It could provide an apparatus having not only a storage reliability of the toner at high temperature and a prevention of deterioration on running, but the very excellent basic specification as a electrophotographic imaging apparatus.

Embodiment of the Apparatus 1

Figure 1:
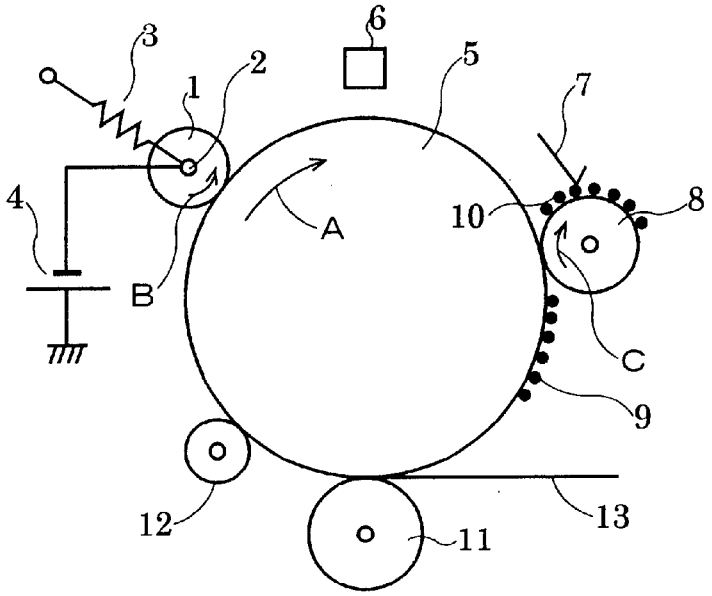
FIG. 1 is a block schematic diagram of an imaging apparatus suitable for this invention.

Specific embodiments of this invention are described with reference to the drawings as follows:

FIG. 1 is a block schematic diagram of an imaging apparatus suitable for this embodiment.

In FIG. 1, a contact-charged member 1 (referred to as a charge roller hereinafter) rotates in the direction of arrow B shown in the figure. A conductive shaft portion 2 is pushed, by means of a specified spring 3, toward an image carrier 5 (referred to as a photoreceptor drum hereinafter) rotating in the direction of arrow A shown in the figure. A DC power supply 4 applies a constant DC voltage to the contact-charged member 1. Then the photoreceptor drum 5 is charged at a constant level.

Next, the charged photoreceptor drum 5 is exposed to light by a latent image-recording-exposure-device 6 (referred to as an LED head hereinafter), and a latent image is formed on the photoreceptor drum 5, then it enters a developing area.

The developing agent carrier 8 (referred to as a developing roller) rotates in the direction of arrow C shown in the figure, and contacts with the photoreceptor drum at an appropriate pressure. Then, a developing agent layer-forming-member 7 (referred to as a developing blade) that forms a developing agent layer on the developing roller 8 contacts with the developing roller 8 at an appropriate pressure, to form a toner layer 10 of 10–50 μm, preferably approximately 15–30 μm, on the developing roller 8. If the toner layer 10 is too thin, it becomes difficult to obtain enough printing density, and if it is too thick, there is a risk of a variation in charge level of individual toner particles.

When the charge distributes broadly, a background fog is likely to be caused owing to the toner with low charge level. Therefore, it is important to frictionally electrify the toner particles uniformly in order to maintain a narrow range of the distribution of the toner charge level. If it could maintain a necessary and sufficient density, the thinner toner layer is the better.

After the electrostatic latent image is formed on the outer surface of the photoreceptor drum 5, a developing agent (referred to as a toner) develops the electrostatic latent image. The toner image 9 formed by development is transferred onto a paper by means of a transfer member 11 (referred to as a transfer roller). A residual toner-recovering member 12 (referred to as a cleaning roller) recovers the toner remaining on the photoreceptor drum 5 after transferring. Thereafter, during the non-developing phase, such as printing suspension or warming-up, a suitable means that is not shown returns toner from the cleaning roller to the photoreceptor drum 5, and the developing roller 8 recycles it into the developing device again.

Figure 2:
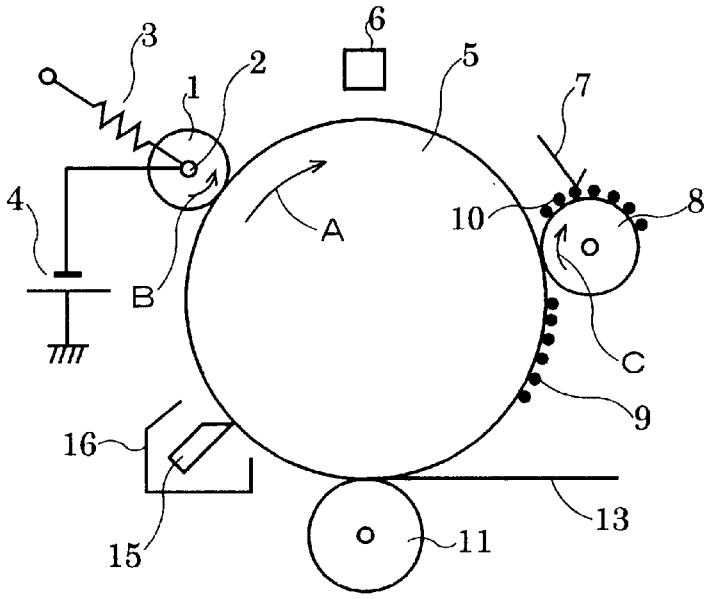
FIG. 2 is a block schematic diagram of another imaging apparatus.

FIG. 2 is an another block schematic diagram of an imaging apparatus.

The apparatus in FIG. 2 has a cleaning blade 15 instead of the cleaning roller 12 shown in FIG. 1. The toner scraped from the photoreceptor drum 5 by this cleaning blade 15 is recovered into the case 16. Such treatment also causes a huge mechanical stress on the toner.

Figure 3:
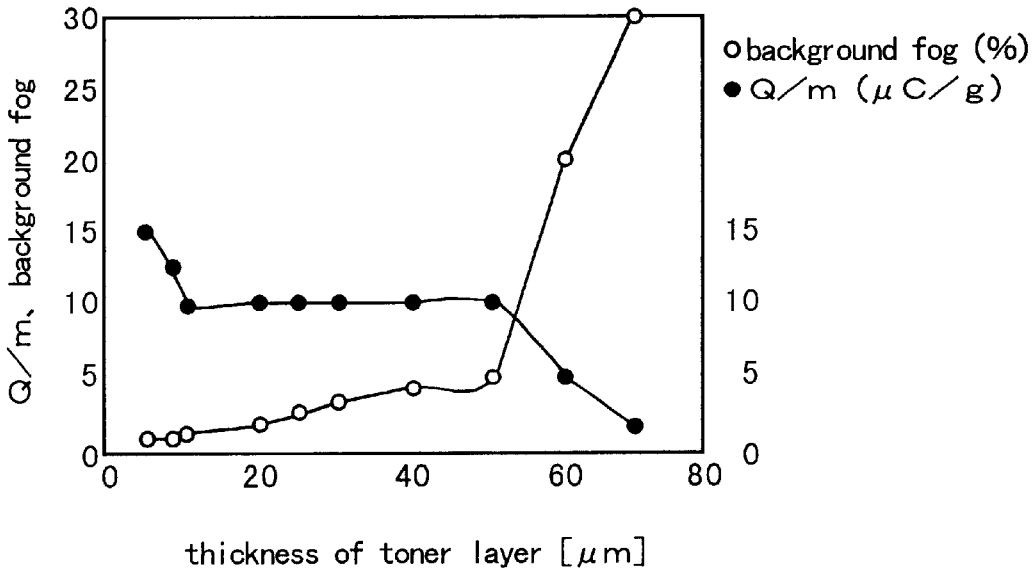
FIG. 3 illustrates a relationship between thickness of the toner layer and background fog or charge level.
Figure 4:
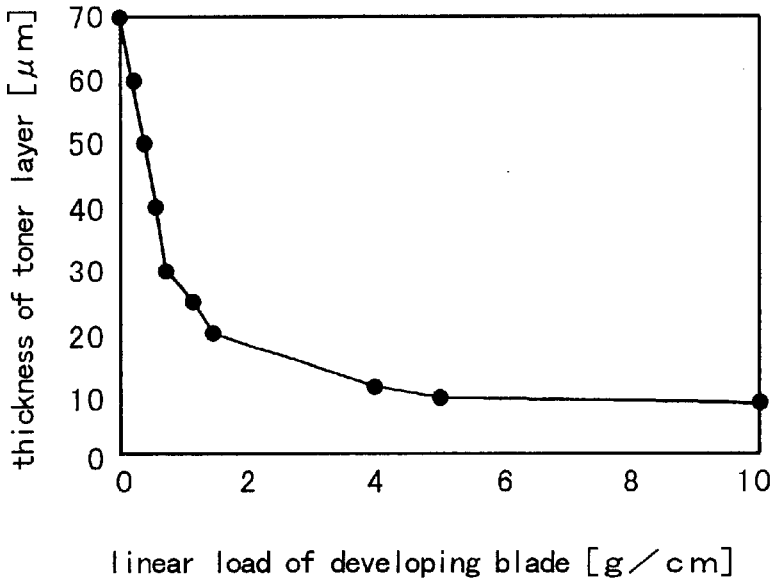
FIG. 4 illustrates a relationship between pressure of the developing blade on the developing roller and thickness of toner layer.

FIG. 3 shows the relationship between a toner layer thickness and a background fog or charge level when the toner of this embodiment is used, and FIG. 4 shows the relationship between an applied pressure from the developing blade to the developing roller and the toner layer thickness.

The background fog becomes larger with an increase in the toner layer thickness. The reason for this is due to an increase in low charged toner particles due to decreased charge level.

The background fog is measured using a spectrophotometric colorimeter (CM-1000, manufactured by Minoruta Corp.) as follows:

First, Scotch Tape (3M Corp.) is stuck on the same paper as used in printing, then reflectance is measured using a spectrophotometric calorimeter. This value is called A. Next, the switch of the imaging apparatus on printing turns off, and the EP cartridge is removed from it. When all white images are exposed and developed, the toner should not deposit to the photoreceptor drum in the case of bad background fog. Scotch Tape (3M Corp.) is stuck on the surface of the photoreceptor drum after the developing step and before the transforming step, then the background fog of the toner which is deposited on the surface of the photoreceptor drum is transferred to the tape. Next, this tape is stuck on the same paper as used in printing, and reflectance is measured using the same calorimeter. This value is called B. Background fog is defined as the value of (A–B)(%).

In order to obtain the printing density needed, a toner layer of about 12 μm or more in thickness is required on the developing roller. A suitable linear load of the developing blade is 4 g/cm in this case. On the other hand, according to the previously described measurement, a toner layer of 50 μm or less in thickness is needed not to generate a background fog. A suitable linear load of the developing blade is 0.3 g/cm in this case.

In other words, it is revealed that 0.3–4 g/cm in linear load of the developing blade is needed in order to achieve good printing quality.

Such linear load of the developing blade causes large mechanical stress to the toner particles while the EP cartridge is used.

When the EP cartridge is transported under a high temperature environment, or is left for a long time after printing, it is subjected to high temperature and high pressure for long time.

In order to endure usage under such environment, increasing a molecular weight of the toner resin or ascending the glass-transition temperature (which will be referred to as a Tg hereinafter) is effective, but these methods put a substantial burden upon the fixing apparatus. Hence, this leads to an elevation of the setting temperature of the fixing apparatus, and eventually leads to an increase in thermal damage of the toner.

If such a countermeasure is actually taken from a view of the toner, the effect is limited, and the burden against the fixing apparatus becomes larger. Moreover, it is difficult to get rid of the so-called trade-off relationship.

Embodiment 1 of the Toner

One of the examples of the preparing method of the capsulated toner, which is used in this embodiment, is described as follows.

Suitable resins used as a core material and a shell material of the capsulated toner in this embodiment include thermoplastic resins such as vinyl resin, polyamide resin, and polyester resin and the like.

Monomers consisting of vinyl resin in the thermoplastic resins above-mentioned are, for example, styrene or styrene derivatives such as styrene, 2,4-dimethylstyrene, α-methylstyrene, p-ethylstyrene, o-methylstyrene, m-methylstyrene, p-methylstyrene, p-chlorostyrene and vinylnaphthalene; ethylenically monocarboxylic acids and their esters such as 2-ethylhexyl acrylate, methyl methacrylate, acrylic acid, methyl acrylate, ethyl acrylate, n-propyl acrylate, isobutyl acrylate, t-butyl acrylate, amyl acrylate, cyclohexyl acrylate, n-octyl acrylate, isooctyl acrylate, decyl acrylate, lauryl acrylate, stearyl acrylate, methoxyethyl acrylate, 2-hydroxyethyl acrylate, glycidyl acrylate, phenyl acrylate, methylα-chloroacrylate, methacrylic acid, ethyl methacrylate, n-propyl methacrylate, isopropyl methacrylate, n-butyl methacrylate, isobutyl methacrylate, t-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethylaminoethyl methacrylate, diethylaminoethyl methacrylate; ethylenically unsaturated monoolefins such as ethylene, propylene, butylene, isobutylene; vinyl esters such as vinyl chloride, vinyl bromoacetate, vinyl propionate, vinyl formate, vinyl capronate; substituted ethylenically monocarboxylic acid such as acrylonitrile, methacrylonitrile and acrylamide; ethylenically dicarboxylic acid or their substituents such as maleate; vinyl ketones such as vinyl methyl ketone; and vinyl ethers such as vinyl methyl ether, and the like.

These resins may be used alone or mixtures thereof to prepare the resin of the core materials and the shell materials.

A monomer composition for forming the resin of the core materials used for this embodiment may include a crosslinking agent, if necessary. Examples of the agent include the conventional crosslinking agent such as divinyl benzene, divinyl naphthalene, polyethyleneglycol dimethacrylate, 2,2'-bis(4-methacryloxy diethoxydiphenyl)propane, 2,2'-bis (4-acryloxy diethoxydiphenyl) propane, diethyleneglycol diacrylate, triethyleneglycol diacrylate, 1,3-butylenglycol dimethacrylate, 1,6-hexyleneglycol dimetahcrylate, neopentylglycol dimethacrylate, dipropyleneglycol dimethacrylate, polypropyleneglycol dimethacrylate, trimethylol propane trimethacrylate, trimetylol propane acrylate, tetramethylol methane tetraacrylate, and the like. Combination of two or more these crosslinking agents may be used as required.

Polymerization initiators used in preparing the thermoplastic resins for the core materials include azo- or diazo-polymerization initiator such as 2,2'-azobis(2,4-dimethylvaleronitrile), 2,2'-azobis isobutylonitrile, 1,1'-azobis(cyclohexane-1-carbonitrile), 2,2'-azobis-4-methoxy-2,4-dimethylvaleronitrile, and the like; and peroxide polymerization initiator such as benzoyl peroxide, methyl ethyl ketone peroxide, isopropyl peroxycarbonate, cumene hydroperoxide, 2,4-dichlorobenzoyl peroxide, lauroyl peroxide, dicumyl peroxide, and the like.

In this embodiment, the core material of the capsulated toner contains a coloring agent, which may be selected from all dyes and pigments used as conventional coloring agents for toner. Examples of the coloring agent for this embodiment include various carbon blacks prepared by a method selected from a group consisting of acetylene black method, thermal black method, channel black method and lamp black method; grafted carbon black whose surface is covered with a resin; Brilliant First Scarlet, Phtalocyanin Blue, nigrosine dyes, Pigment Green B, Rhodamine B Base, Permanent Brown FG, Solvent Red 49 and a mixture thereof.

In this embodiment, a charge-controlling agent may be incorporated into the core material. Examples of the negatively charged charge-controlling agents include, but are not be limited to, AIZENSPIRON BLACK TRH available from Hodogaya Chemical Ltd., metal alloy azo dyes such as BONTRON S-31, BONTRON S-32, BONTRON S-34, BARIFIRST BLACK 3804 (all manufactured by Orient Chemical Ltd.), quaternary ammonium salts such as COPY CHARGE NX VP 434 available from Hoechst Ltd., copper phthalocyanine dyes of nitroimidazole derivative, metal complexes of alkyl salicylate derivatives such as BONTRON E-81, BONTRON E-85 available from Orient Chemical Ltd., and the like.

Examples of a positively charged charge-controlling agents, which are intended to limit the above-mentioned negatively charged charge-controlling agents, include Nigrocine dyes such as OIL BLACK BS, BONTRON N-01, BONTRON N-07, BONTRON N-11, NIGROCINE BASE EX, OIL BLACK SO which are available from Orient Chemical Ltd., triphenylmethan dyes containing tertiary amine as a side chain, quaternary ammonium salt compounds such as BONTRON P-51 available from Orient Chemical Ltd., cetyltrimethyl ammonium bromide, COPY CHARGE PX VP 435 available from Hochest Ltd., polyamine resin such as AFP-B available from Orient Chemical Ltd., and imidazole derivatives, and the like.

If necessary, one or more offset preventing agents may be optionally incorporated into the core material to improve the offset resistance. Examples of the offset preventing agents include, for example, polyolefins, metal salts of fatty acid, higher fatty acids, fatty acid esters, partially saponified fatty acid esters, higher alcohols, paraffin waxes, silicon oils, amide waxes, silicon vanishes, polyhydric alcohols and aliphatic fluorocarbons.

For example, polypropylene, polyethylene, polybuten are polyolefins as above-mentioned.

Examples of the metal salt of fatty acid include zinc, magnesium or calcium metal salt of maleic acid; zinc, cadmium, barium, lead, iron, nickel, cobalt, copper, aluminum, or magnesium metal salt of stearic acid; dibasic lead stealate; zinc, magnesium, iron, cobalt, copper, lead or calcium metal acid of oleic acid; aluminum or calcium metal salt of palmitic acid; a salt of capric acid; lead caproate; zinc or cobalt metal salt of linolic acid; calcium ricinoleate; zinc or cadmium metal salt of ricinolic acid, and mixtures thereof.

Examples of fatty acid esters include ethyl maleate, butyl maleate, methyl stearate, butyl stearate, cetyl palmitate, ethylene glycol ester of montanic acid, and the like.

Examples of partially saponified fatty acid include a montanic acid ester partially saponified with calcium. Example of higher fatty acid include dodecanoic acid, lauric acid, myristic acid, palmitic acid, stearic acid, oleic acid, linolic acid, ricinolic acid, arachic acid, behenic acid, lignoceric acid, selacholeic acid, and a mixture thereof.

Examples of higher alcohol include dodecyl alcohol, lauryl alcohol, myristyl alcohol, palmityl alcohol, stearyl alcohol, and the like. Examples of the paraffin wax above-mentioned include natural paraffins, microwax, synthetic paraffin, chlorinated hydrocarbon and the like.

Examples of the amide wax include stearic acid amide, oleic acid amide, palmitic acid amide, lauric acid amide, behenic acid amide, methylenebis stearamide, ethylenebis stearamide, N,N'-m-xylylenebis (stearic acid amide), N,N'-m-xylylenebis-(12-hydroxystearic acid amide), N,N'-isophthalic acid bisstearylamide, N,N'-isophthalic acid bis-(12-hydroxy stearylamide), and the like.

Examples of the polyhydric alcohol ester include glycerin stearate, glycerin ricinoleate, glycerin monobehenate, sorbitan monostearate, propylene glycol monostearate, sorbitan trioleate, and the like. Examples of silicone varnish include methyl silicone varnish, phenyl silicone varnish, and the like. Examples of the aliphatic fluorocarbon include low molecular weight compounds of ethylene tetrafluoride and propylene hexafluoride.

Among the materials listed above, at least the polymerizable monomer, the polymerization initiator and the coloring agent which form the core material are blended, and if necessary, the crosslinking agent, the wax, and the charge-controlling agent are further blended to form the mixture.

This mixture is dispensed into a dispersion medium and polymerized to form a particle of the core.

Examples of the dispersion medium include water, methanol, ethanol, propanol, butanol, ethyleneglycol, glycerin, acetonitrile, acetone, isopropyl ether, tetrahydrofuran, dioxane, and the like. These may be used alone or in combination. A dispersion stabilizer may be used to stabilize a dispersion of the dispersion medium. All of the known dispersion stabilizers may be used. Examples of the agents include polyvinyl alcohol, polystyrene sulfonate, hydroxymethyl cellulose, hydroxyethyl cellulose, hydroxypropyl cellulose, carboxymethyl cellulose, sodium polyacrylate, sodium dodecylbenzene sulfonate, sodium tetradecyl sulfate, sodium pentadecyl sulfate, sodium octyl sulfate, sodium allyl-alkyl-polyether sulfonate, sodium oleate, sodium laurylate, sodium caprinate, sodium caprylate, sodium caproate, potassium stearate, calcium oleate, sodium 3,3-disulfone diphenyl urea-4,4-diazo-bis-amino-β-nawatol-6-sulfonate, ortho-carboxybenzene-azo-dimethyl aniline, sodium 2,2,5,5-tetramethyl-triphenylmethan-4,4-diazo-bis-β-naphtol-disulfonate, tricalcium phosphate, ferric hydroxide, titanium hydroxide, aluminum hydroxide, and the like. These dispersion stabilizers may be used alone or in combination of two or more.

The suspension thus obtained is kept at 50 to 100 □ with stirring to continue or complete the polymerization.

During or after completing the polymerization, the second polymerizable monomer is added to the suspension to conduct the seed polymerization. That is, by the first polymerization, the aqueous suspension comprising particles of thermoplastic resin containing a coloring agent (referred to as an "intermediate particle" hereinafter), which is partially or completely polymerized, is prepared. At least the vinyl polymerization initiator and the vinyl polymerizable monomer are added to the suspension, and after the vinyl polymerizable monomer is absorbed by the intermediate particles, monomers in the intermediate particles are polymerized therein.

The vinyl polymerizable monomer that can be absorbed by the intermediate particles may be directly added alone, or may be added in the form of aqueous emulsion. The aqueous emulsion added is the emulsion in which a vinyl polymerizable monomer and a vinyl polymerization initiator are emulsified and dispersed together with a dispersion stabilizer in water. If necessary, a crosslinking agent, an offset preventing agent and a charge-controlling agent may be added thereto.

The shell material may be prepared by using the same vinyl polymerization initiator, crosslinking agent and dispersion stabilizer for seed polymerization as those used in the production of the intermediate particle. If necessary, polymerization conditions of resins for forming the shell can be optimized by using water-soluble polymerization initiators.

It is desirable that polymerizable monomer used herein are selected to be resins having a Tg of above 75° C. after polymerization. In other words, it is desirable that the Tg of the shell resin is 75° C. or above. No prior art have reported that a capsulated toner is prepared with sufficiently elevating the Tg of the shell resin in order to ensure enough blocking resistance.

As illustrated in the embodiment of the present invention, it is very effective that the Tg of resins consisting of the outermost layer is 75° C. or above with respect that it has enough blocking resistance.

The addition of the vinyl polymerizable monomer or aqueous emulsion causes the surface of intermediate particles to be coated with the vinyl polymerizable monomer, and swelling of the core particle to a same extent. Then the polymerization of the polymerizable monomer, i.e. seed polymerization which uses the intermediate particles as core particles, proceeds to produce shell resins under this condition, so that the capsulated toner is completed.

The above-mentioned process provides good core fixing at low energy and good blocking resistance even under high temperature and high pressure; thus, the capsulated toner in which the fixation at a low temperature and an offset resistance are highly balanced can be obtained.

Although there is not any particular limitation regarding a particle diameter of the capsulated toner in this embodiment, it is preferable that the average particle diameter usually ranges from 3 to 30 μm.

The capsulated toner in this embodiment may include a flow improver and a cleaning improver, if necessary. Examples of the flow improver are silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide, silicon nitride, and the like.

The fine powder of silica means a fine powder of a compound having a Si—O—Si bond and may be produced by either dry or wet processes. The fine powder of silica such as aluminum silicate, sodium silicate, potassium silicate, magnesium silicate, zinc silicate, as well as anhydrous silicon dioxide may be used. In addition, the fine powder of silica having a surface treated with a silane coupling agent, a titanium coupling agent, a silicone oil, a silicone oil having amine on its side chain may be used.

Examples of the cleaning improver include fine powders of a metal salt of a higher fatty acid represented by zinc stearate, and fluoropolymer, and the like. Furthermore, the additives for regulating developability, such as fine powders of a polymer of methyl methacrylate, butyl methacrylate or others, may also be used.

When the heat pressure-fixable capsulated toner of this embodiment contains a fine powder of a magnetic substance, it can be used alone as a developing agent. When the toner does not contain the fine powder of the magnetic substance, it may be used as a nonmagnetic-element-developing agent, or it may be used by mixing with a carrier to prepare a binary developing agent.

Examples of a carrier include iron powder, ferrite, glass beads, or the same materials coated with resin, as well as a resin carrier produced by incorporating a fine powder of magnetite or ferrite with a resin, but it is not limited to them. A mixing ratio of the toner to the carrier is from 0.5 to 20 parts by weight. A particle diameter of the carrier may be 15 to 500 $\mu$m.

Embodiment 2 of the Toner

These inventors tried to solve the above-mentioned problems, and found that the above-mentioned problems could be solved through the use of the developing agent including a resin which had the highest Tg of 75° C. or more, and preferably 85° C. or more, among resins consisting of the developing agent, in an electrophotographic imaging apparatus having the contact developing system, and more specifically, the contact developing system whose pushing-pressure of a developing drum on a photoreceptor drum was 2–30 g/mm.

Also, they elucidated that such toner consisted of two or more resins having different Tgs, and that the resins having a capsular structure were extremely effective.

The usage of such toner allows the contact-pressure between the photoreceptor drum and the developing roller to be set as necessary to obtain enough frictional charge level. Additionally, it increases the toner storage reliability under high temperatures, and prevents deterioration in a running condition. Apparatuses having superior basic performance as the imaging apparatus of electrophotography can thus be provided.

Then, this second embodiment can be carried out in the imaging apparatus having the configuration described in FIG. 1 as is the case of the first embodiment.

Figure 7:
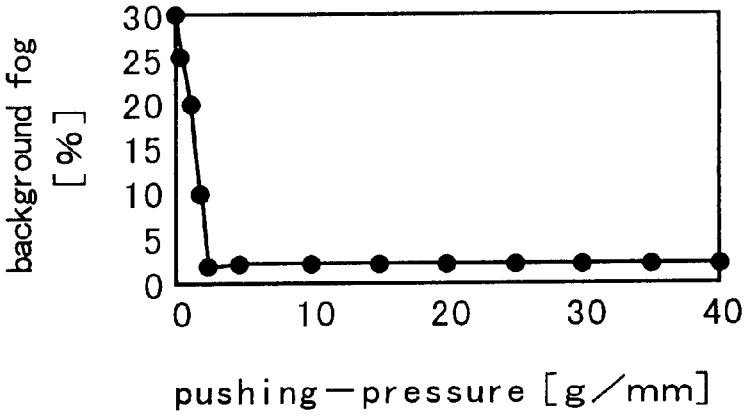
FIG. 7 illustrates a relationship between background fog and pushing-pressure of the developing roller on the photoreceptor drum.

FIG. 7 shows the relationship between the pushing-pressure from the developing roller to the photoreceptor drum (hereinafter referred to just as pushing-pressure) and background fog when using the toner of this embodiment.

Figure 8:
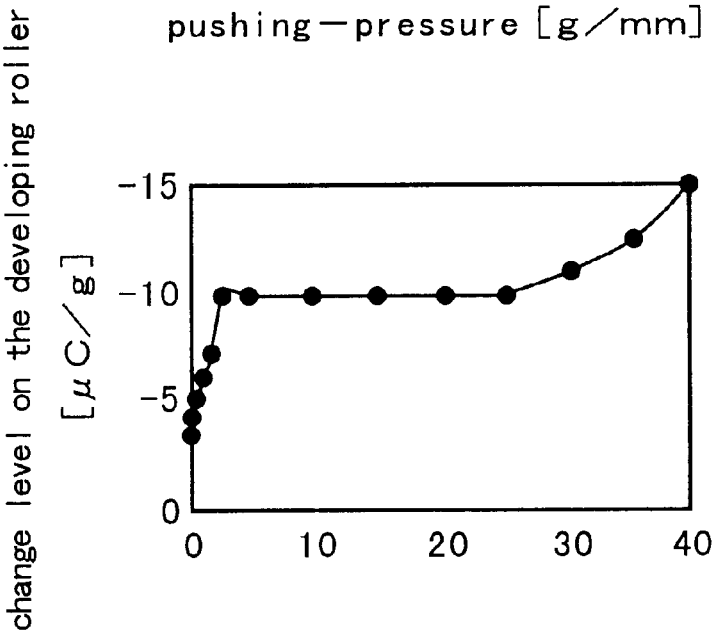
FIG. 8 illustrates a relationship between pushing-pressure and charge level of the toner layer on the developing roller.

FIG. 8 shows the relationship between the pushing-pressure and the charge level of the toner layer on the developing roller.

As shown in FIG. 7, as the pushing-pressure increases, the background fog decreases. And as shown in FIG. 8, as the pushing-pressure increases, the charge level of the toner in the developing area also increases.

The charge level of the toner ($\mu$C/g) is defined as follows:

$q=(2Vt\times\epsilon O\epsilon t)/\delta P(dt)^2$

2Vt: surface potential of toner layer on a developing roller (V)

$\epsilon O$: permittivity in vacuum $8.855\times10^{(-12)}$C/(Vm)

$\epsilon t$: relative permittivity of toner layer 1.44

$\delta$: true density of toner $1.175\times10^3$ (kg/m$^3$)

P: filling factor of toner layer 0.4 dt: thickness of toner layer (m).

The charge level of the toner is the value just before developing. That is, the value calculated from the potential Vt after receiving a charge caused by frictional electrification between the toner on the developing roller and the photoreceptor drum. The charge level of the toner layer on the developing roller immediately following the passage through the blade after solid printing, and the toner charge level on the developing roller measured without equipping the photoreceptor drum are matched at −3 $\mu$C/g. As a result, the charge level that the toner obtains from the developing device of this experiment may be considered as −3 $\mu$C/g independently of the friction with the photoreceptor drum.

According to the inventor's discussion, it is confirmed that when this pushing-pressure decreases below 2 g/mm, background fog increases suddenly, and when decreases below 1 g/mm, printing density begins to decrease. Therefore, insufficient pushing-pressure makes the frictional electrification ineffective, generates reverse charged toner, and is prone to cause fog. It is also confirmed that if pushing-pressure decreases, the developing nip becomes unstable, which reduces an efficiency of developing to cause a reduction in density.

According to the inventor's discussion, it is necessary for high printing quality that the absolute value of the toner charge level shall be not less than about 10 $\mu$C/g.

The requirement for this is a pushing-pressure of 2 g/mm or more.

On the other hand, a pushing-pressure of over 30 g/mm subjects the toner to excessive stress. As the result, it is confirmed that deterioration of the toner is accelerated in running.

Then, it is confirmed that such high pushing-pressure increases mechanical stress of the EP cartridge to arise jetter noticeably.

Then, pushing-pressure from 2 g/mm to 30 g/mm is desirable.

These inventors prepared the toner having a charge level of 10 $\mu$C/g even with a pushing-pressure of the order of 1 g/mm by comprising increase charge-controlling agent (CCA) of excessive volume, and reviewed its properties.

In the system using this toner, however, charge level widely varies depending on environmental variations. If the pushing-pressure is 1 g/mm at room temperature (25° C., 55 RH %), 10 $\mu$C/g of charge level is obtained, but at a low temperature and low humidity (10° C., 20 RH %), 20 $\mu$C/g, and at a high temperature and high humidity (30° C., 80 RH %), 8 $\mu$C/g.

It is confirmed that under usage conditions of the above-mentioned toner, low temperature and low humidity condition causes excessive charge, then the problem that the toner is deposited to the background by developing are arisen.

In contrast, the combination of the above-mentioned charge-controlling agent and the toner that prepared to have a charge level of 10 $\mu$C/g at 10 g/mm in pushing-pressure provides 11 $\mu$C/g in charge level at low temperature and low humidity (10° C., 20 RH %), and 8 $\mu$C/g in charge level at high temperature and high humidity (30° C., 80 RH %), then extreme changes of charge level have not occurred depending on environmental variations.

Hence, it is confirmed that even though attempting to keep large amounts of charge level on the actual apparatus by the addition of excessive volume of the charge-controlling agent, it entails practical difficulties.

In the electrophotography, it is unavoidable that the charge level varies by environmental variation (especially humidity), as charge of the toner depends on the phenomenon of frictional electrification.

However, design principles that enough charge level on the actual apparatus is obtained by only increasing the charging capacity of the toner is not correct. It is a foregone conclusion that the characteristic of the toner having a large surface area in the cumulative sum is dependent on environmental variations.

The above facts prove that the conditions of the apparatus which transfer charge to the toner are suitable, namely that friction force among various rollers (including the photoreceptor drum) which is the prime mover of frictional electrification is more than a certain value, more specifically that pushing-pressure and so on are some extent high.

When a contact-pressure is kept in a previously described range, a contact-developing system providing high quality printed matter is completed. Such relative high pushing-pressure, however, still has the problem that the toner particle placed between the photoreceptor drum and the developing roller is subjected to high pressure along with a high temperature for a long time, if the EP cartridge is left in a high temperature environment for a long time after printing.

A useful method for ensuring the toner is capable of enduring use in a state of applying a high pressure is to increase the molecular weight of the toner resins, or through the elevation of a Tg, and so on. These methods, however, increase the burden to the fixing apparatus. In other words, it leads to a higher fixing temperature of the fixing apparatus, which eventually leads to a increase in thermal damage to the toner.

This is a reason why the contact-developing system is difficult.

As mentioned above, this embodiment solves problems that the contact-developing system has by the use of toner having a capsular structure described as below, and can make the best of its simple structure.

Embodiments of the Apparatus 2

Figure 11:
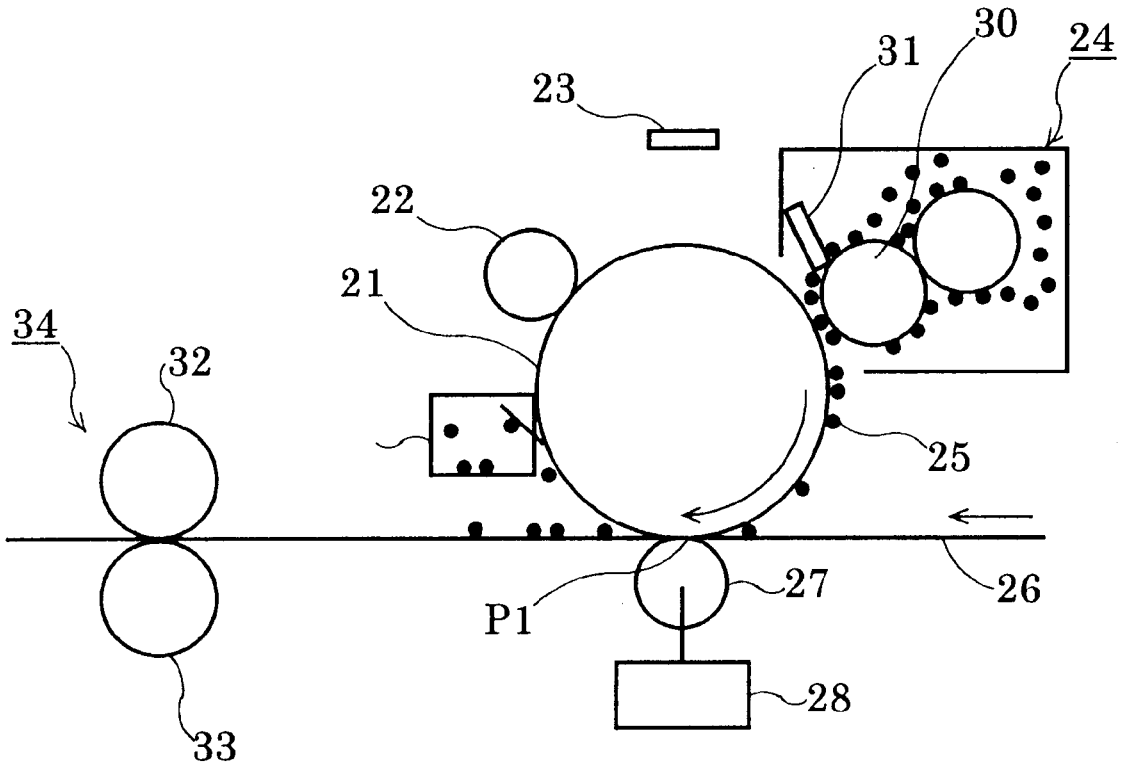
FIG. 11 is a block schematic diagram of an imaging apparatus used for embodiment 3 of the toner of this invention.

FIG. 11 is a block schematic diagram of an another imaging apparatus.

In this figure, a charge roller 22 is placed in contact with a photoreceptor drum 21 that is free to rotate. After applying a negative charge to the charge roller 22, the surface of the photoreceptor drum 21 is uniformly and evenly negatively charged. The surface of the photoreceptor drum 21 is exposed to the light from an LED head 23 to form an electrostatic latent image, and more specifically, the image.

Next, in a developing device 24, a charged capsulated toner (developing agent) 25 on a developing roller 30 is laminated by a developing blade 31, then depositing to the electrostatic latent image to form a toner image. The capsulated toner 25 consists of a core, and at least one layer shell prepared by coating the surface of the core, and has a multilayer structure.

Following this step, a paper 26 is transported towards a transfer part P1 formed between the photoreceptor drum 21 and a transfer roller 27. If a positive transfer voltage is applied to the transfer roller 27 by a transferring-power supply 18 at this time, a transfer electric field is generated between the photoreceptor drum 21 and the transfer roller 27. As the capsulated toner 25 receives the coulomb energy from the transfer roller 27, the capsulated toner 25 is deposited to the paper 26. Hence, the toner image is transferred to the paper 26.

Following this step, the paper 26 is transported towards the fixation device 34 consisting of the heat roller 32 and a pressure roller 33. The toner image on the paper 26 is fixed by the fixation device 34. On the other hand, a cleaning device 29 removes the capsulated toner 25 remaining on the surface of the photoreceptor drum 21 after transferring.

Embodiments described below can be used for the imaging apparatus having the above-stated structure. However, a toner described in any of the first three embodiments, may be extensively used in a development within an electrophotographic printer having optional structure that operates on a similar principle.

Embodiment 3 of the Toner

By the way, if a Tg of the shell is reduced under 70° C., the capsulated toner 25 used in the developing device 24 in the nonmagnetic-element contact developing system deposits to the developing roller 30. The toner 25 used in a developing device (not shown in the figure) in the binary developing system deposits to a carrier (not shown in the figure). Both of these may generate a filming phenomenon.

This filming phenomenon strongly depends on a Tg of a shell. When a Tg of a shell is above 75° C. the phenomenon is not generated, but when a Tg is under 45° C. it is extremely generated. As the result of this temperature profile and the SEM (electron microscope) observation of the deteriorated capsulated toner 25, it is found that the capsulated toner 25 deposits to the developing roller 20 or a carrier after heating of its surface to a high temperature to melt.

Therefore, if a Tg of the shell is low, a durability of the capsulated toner 25 is reduced.

The above-mentioned facts are confirmed by tests described below.

First, a preparing method of the capsulated toner 25 used in tests is illustrated.

The following mixture was put into an attritor ("MA-01SC" manufactured by Mitsui Miike Engineering Corp.) and dispersed at 15° C. for 10 hours, to prepare a polymerizable composition:

Component of mixture:

| | |
|---|---|
| Styrene: | 77.5 parts by weight |
| n-butyl acrylate: | 22.5 parts by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printex L" manufactured by Degusa Co. Ltd.) | 7 parts by weight |
| 2,2'-Azo bis-isobutyronitrile | 1 part by weight |

Eight parts by weight of polyacrylate and 0.35 part by weight of divinylbenzen were solved in 180 parts by weight of ethanol. 600 Parts by weight of distilled water was added to the mixture to prepare a dispersion medium for polymerization. The polymerizable composition was added to the dispersion medium and dispersed at 15° C. for 10 minutes at a rate of 8,000 r.p.m in a TK homomixer ("M Type" manufactured by Tokusyu Kika Kogyo Co., Ltd.) to prepare a dispersion.

Next, the resultant dispersion was put into a separable-one litter flask and reacted at 85° C. for 12 hours under a nitrogen flow with stirring at a rate of 100 r.p.m. The dispersoid obtained by polymerization of the polymerizable composition in these steps is referred to as an "intermediate particle".

Next, 7.5 parts by weight of methyl methacrylate, 2.5 parts by weight of n-butyl acrylate, 0.5 part by weight of 2,2'-azo bis-isobutyronitrile as a polymerization initiator, 0.1 part by weight of sodium laurylsulfate, and 80 parts by weight of water were mixed, and the mixture was treated by a ultrasonic generator ("US-150", Nippon Seiki Industry Co., Ltd.) to prepare an aqueous emulsion A. Four parts by weight of the aqueous emulsion A was dropped to the aqueous suspension of the intermediate particles to swell the particles. Just after dropping, and observing the aqueous suspension by an optical microscope, no droplet of the emulsion was visible. It was therefore confirmed that the swelling had occurred for a very short time.

The suspension was further reacted as the second polymerization at 85° C. for 10 hours under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hours under a reduced pressure of 10 mmHg, and classified by air classifier to obtain a capsulated toner having an average particle diameter of 7 μm.

A Tg of the resin particle obtained before the seed polymerization was 55° C. It means that a core of the capsulated toner 25 obtained in this embodiment has a Tg of 55° C.

The thermoplastic resin obtained by polymerization of aqueous emulsion A alone has a Tg of 75° C. It means that a shell of the capsulated toner obtained in this embodiment has a Tg of 75° C.

To 50 parts by weight of the resultant capsulated toner, 0.35 parts by weight of a fine powder of a hydrophobic silica "Aerosil R-972" (manufactured by Japan Aerosil Co., Lid.) was added to obtain the capsulated toner 25 of the present invention. The capsulated toner 25 is used by way of each developing manner of a nonmagnetic-element contact developing system or a binary developing system.

The capsulated toner 25 used in a magnetic-element developing system is added to ferric powder having an average diameter of 3 μm, 30 parts by weight to the polymerizable monomer, in the preparing step of the polymerizable composition which is used for forming the aforementioned intermediate particle, as well as the formulation of the capsulated toner 25 used in the above-mentioned nonmagnetic-element contact developing system.

Loadings of the polymerizable composition to form the shell of the capsulated toner 25 of this embodiment are not specially limited to, but 4 parts of weight or less to the polymerizable composition to form the core is desirable (the capsulated toner 25 used in magnetic-element developing system does not include the weight of a magnetic powder in the weight of the polymerizable composition of core.)

It is apparent that an increase in a thickness of the shell by highly increased loadings allows an improved durability and stability of the capsulated toner 25, but these means cause not only a decreasing fixability of the capsulated toner 25, but also a deteriorating electrostatic property.

Thus, pressure conditions under the fixing step of this embodiment are useful when loadings of the polymerizable composition to form the shell is 4 parts by weight or less based on the polymerizable composition to form the core.

FIG. 12 illustrates results of the durability test of the capsulated toner in the embodiment of the present invention. In this figure, "presence" means that filming phenomenon occurs, and "absence" means that no filming phenomenon occurs. "Absence" at shell row means it is the polymerization toner having a monolayer structure without a shell.

In this case, a Tg of the core is obtained by varying the composition ratio of styrene and n-butyl acrylate, and a Tg of the shell is obtained by varying the composition ratio of methyl methacrylate and n-butyl acrylate. Hence the other properties of each capsulated toner 25 (FIG. 11) are same.

The capsulated toner 25 prepared as described above is used by different developing systems, such as the nonmagnetic-element contact-developing system, the binary developing system and the magnetic-element developing system, and exhibited durability of the capsulated toner in continuous printing.

In the nonmagnetic-element contact-developing system, continuous printing was performed while the developing roller 30 made of silicone rubber was used, and contact-pressure of the developing roller 30 on the photoreceptor drum 21 was 200 g/cm, and contact-pressure of the developing blade 31 on the developing roller 30 was 20 g/cm.

In the binary developing system, continuous printing was performed while a ferric carrier having an average diameter of 50 μm was used, the toner concentration to the carrier was 5% by weight, and a thickness of the toner layer on a magnet roller (not represented in the figure) was 100 μm.

Then, using the magnetic-element developing system, continuous printing was performed while the thickness of the toner layer on a magnet roller was 50 μm.

In any case, 20,000 of A4 size paper 26 were printed under 5% in a printing density and 200 mm/sec in a printing speed. The capsulated toner 25 disposed in the developing device 24 was regarded as empty at the time point when printed characters have a thin-spot, and the capsulated toner 25 was supplied. Loading per one time was 100 g.

As a result of this, it is apparent that the filming phenomenon depends on each Tg of core and shell in each developing system, as shown in the figures. The nonmagnetic-element contact-developing system and the magnetic-element developing system previously described show no deposit of capsulated toner 25 to the developing roller 30, and the binary developing system shows no deposit of capsulated toner 25 to the magnet roller, but there was a deposit of capsulated toner 25 to the carrier. It is apparent that the capsulated toner 25 having a Tg of shell of 75° C. or less is more likely to generate filming phenomenon than the polymerization toner having a monolayer structure having the same Tg.

This reason is considered to be because the Tg of the shell actually formed is considerably lower than the designed value due to the compatibility of the core and the shell. It is also assumed, based on the fact that when two capsulated toners 25 having the same Tgs of shells and different Tg of cores were made, the generation of filming phenomenon is noticeable in the capsulated toner 25 having the lower Tg.

The filming phenomenon was also generated in the capsulated toner made by interfacial polymerization. When the toner was prepared by the interfacial polymerization, the interface between the core and shell was relatively clear. This reason is because they are agitated in the developing device 24, then the shell of some capsulated toner is peeled off owing to friction, which causes the core to be exposed.

Next, a blocking resistance that is the indicator of storage stability of the capsulated toner 25 under high temperature is described.

FIG. 13 illustrates results of a high temperature standing test of the capsulated toner of the embodiment of the present invention. In FIG. 13, O represents there is no practical problem if the capsulated toner 25 (FIG. 11) is used, Δ represents there is a problem if the capsulated toner 25 is used, x represents the capsulated toner 25 could not be used at all, and blank represents it is the polymerization toner having monolayer structure in absence of a shell.

In this case, a cylindrical container having 20 $cm^2$ in base area is filled with 20 g of the capsulated toner 25, then capped and weighted on the cap to press at 500 $g/cm^2$. The capsulated toner 25 is kept at 50° C. under this condition for one month. All of the capsulated toner 25 is poured onto a sieve of 45 μm mesh, vibrated at 1 kHz for 30 seconds, and then the capsulated toner 25 retained on the sieve was weighed. When a weight of the initial capsulated toner 25, weight of the capsulated toner 25 on the mesh, and blocking ratio are represented as W1, W2, and Σ, respectively, the blocking ratio Σ is described as following:

$$\Sigma=(W2/W1)\times 100(\%)$$

The reason for applying pressure to the capsulated toner 25 is to assume the capsulated toner 25 is housed in the developing device 24 in the nonmagnetic-element contact developing system.

The blocking ratio Σ of 0–5% means there is no practical problem if the capsulated toner 25 is used, 5–10% means there is a problem if the capsulated toner 25 is used, 10% or more means the capsulated toner 25 could not be used at all.

As the result of this, it is apparent that blocking resistance depends on each Tg of core and shell in each developing system. Although it is taken for granted based on object of capsulation of the capsulated toner 25, it is found that the capsulated toner 25 in the durability test put under more rigorous conditions than that in the shelf test at high temperature.

Therefore, in order to improve fixability and blocking resistance of the capsulated toner 25, conditions that the capsulated toner 25 exerts their advantage is reviewed while a Tg of the shell is kept at 75° C. or more.

In this case, Scotch Tape (manufactured from 3M Co.) is overlaid on the solid black part obtained from solid black printing, then applying a pressure of 50 g/cm$^2$ to the Scotch Tape by reciprocation, then removed said Scotch Tape at a rate of 3 cm/sec. When density before peeling, after peeling, and fixation ratio is represented as d1, d2, and η, the fixation ratio η is described as following:

$$\eta=(d2/d1)\times 100(\%)$$

The fixation ratio η of 90–100% means there is no practical problem if the capsulated toner 25 is used, 70–90% means there is a problem if the capsulated toner 25 is used, 70% or less means the capsulated toner 25 could not be used at all.

Accordingly, a Tg of the shell of the capsulated toner 25 is adjusted from 75 to 100° C. in this embodiment of the present invention.

As will be discussed later, fixation pressure, which is applied to the paper 26 by the heat-roller 22 and the pressure-roller 23, is adjusted from 400 to 1400 g/cm in linear load.

According to the above manner, stability of the capsulated toner 25 at high temperature can be improved because of a Tg of the shell being higher than that of the core.

Then, when a Tg of the shell is in a range between 75 and 100° C., and fixation pressure in linear load is in a range between 400 and 1400 g/cm, durability and blocking resistance of the capsulated toner 25 is improved, and the fixation ratio η may be elevated.

EXAMPLES

The present invention will be illustrated hereinbelow based on comparative examples and working examples, it being noted that these examples are not intended to limit the scope of the present invention.

Examples and Comparative Examples on Embodiment 1

Example 1-1

The developing blade is adjusted to make the toner layer of 20 μm in thickness within the imaging apparatus having a structure described in FIG. 1 and FIG. 2.

Also, the toner having capsular structure was presented according to the method mentioned below.

The following mixture was put into an attritor ("MA-01SC" manufactured by Mitsui Miike Engineering Corp.) and dispersed at 15 □ for 10 hours, to prepare a polymerizable composition.

Component of Mixture:

| | |
|---|---|
| Styrene: | 77.5 parts by weight |
| n-butyl acrylate: | 22.5 parts by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printex L" manufactured by Degusa Co. Ltd.) | 7 parts by weight |
| 2,2'-Azo bis-isobutyronitrile | 1 part by weight |

Eight parts by weight of polyacrylate and 0.35 part by weight of divinylbenzen were dissolved in 180 parts by weight of ethanol. 600 parts by weight of distilled water were added to the mixture to prepare a dispersion medium for polymerization. The polymerizable composition was added to the dispersion medium and dispersed at 15° C. for 10 minutes at a rate of 8,000 r.p.m in a TK homomixer ("M Type" manufactured by Tokusyu Kika Kogyo Co., Ltd.). The resultant dispersion was put into a separable-one litter flask and reacted at 85° C. for 12 hours under a nitrogen flow while stirring at a rate of 100 r.p.m. The dispersoid obtained by polymerization of the polymerizable composition in these steps is referred to as "intermediate particle".

Next, 9.25 parts by weight of methyl methacrylate, 0.75 part by weight of n-butyl acrylate, 0.5 part by weight of 2,2'-azo bis-isobutyronitrile, 0.1 part by weight of sodium laurylsulfate, and 80 parts by weight of water were mixed to the aqueous suspension of the intermediate particle, and the mixture was treated by ultrasonic generator ("US-150", Nippon Seiki Industry Co., Ltd.) to prepare aqueous emulsion A. Nine parts by weight of aqueous emulsion A was dropped to the aqueous suspension of the intermediate particles to swell the particles. Just after dropping, observing the aqueous suspension by an optical microscope, no droplet of the emulsion was visible. It was therefore confirmed that the swelling had occurred for a very short time.

The suspension was further reacted as the second polymerization at 85° C. for 10 hours under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hours under a reduced pressure of 10 mmHg and classified by air classifier to obtain a capsulated toner having an average particle diameter of 7 μm.

A Tg of the resin particle obtained before the seed polymerization was 55° C. It means that a core of the capsulated toner obtained in this example has a Tg of 55° C.

The thermoplastic resin obtained by polymerization of aqueous emulsion A alone has a Tg of 85° C. It means that a shell of the capsulated toner obtained in this example has a Tg of 85° C.

To 50 parts by weight of the resultant capsulated toner, 0.35 parts by weight of a fine powder of a hydrophobic silica "Aerosil R-972" (manufactured by Japan Aerosil Co., Lid.) was added to obtain the capsulated toner of this embodiment.

The toner was packed into the EP cartridge, and subjected to a one-month shelf test at 50° C. (to ensure the shelf stability under the limit), and checked presence or absence of deposit of the toner on the surface of the developing blade and the surface of the developing roller at contact area of both the blade and the roller.

No deposit of toner was observed on the developing blade and the surface of the developing roller in contact with the developing blade. After the shelf test, the EP cartridge packed the toner set to the LED Printer OKI MIKROLINE 16n to carry out the initial printing. Neither abnormal printing at the pitches derived from perimeters of the developing roller or the photoreceptor drum, nor fog were observed, to obtain the printed matter with good printing quality accompanying enough density and resolution.

After this, running printing of 30,000 prints was performed with A4 size under PRINTING DYUTY 15%.

The printing quality of the printed matter at the end of running was as good as the initial printing, which provided the printed matter of extremely high quality.

Then, FIG. 6 showed the observation of fluidity of toner remaining in the EP cartridge at the end of running. The test performed in this example showed no change in fluidity from the initial printing, and maintaining superior powder fluidity.

Example 1-2

The capsulated toner was prepared with the same way of Example 1-1, except that preparing the aqueous emulsion B by varying composition ratio of aqueous emulsion A in Example 1-1.

That is, 8.75 parts by weight of methyl methacrylate, 1.25 part by weight of n-butyl acrylate, 0.5 part by weight of 2,2'-azo bis-isobutyronitrile, 0.1 part by weight of sodium laurylsulfate, and 80 parts by weight of water were mixed to the aqueous suspension of the intermediate particle obtained in Example 1-1, and the mixture was treated by ultrasonic generator ("US-150", Nippon Seiki Industry Co., Ltd.) to prepare aqueous emulsion B.

Nine parts by weight of aqueous emulsion B were dropped to the aqueous suspension of the intermediate particles to swell the particles. Just after dropping, observing the aqueous suspension by an optical microscope, no droplet of the emulsion was visible. It was therefore confirmed that the swelling had occurred for a very short time. The suspension was further reacted as the second polymerization at 85° C. for 10 hours under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40 □ for 10 hours under a reduced pressure of 10 mmHg and classified by air classifier to obtain a capsulated toner having an average particle diameter of 7 $\mu$m.

A Tg of the thermoplastic resin obtained in the polymerization of aqueous emulsion B alone was 75° C. It means that the resin derived from shell has a Tg of 75° C.

To 50 parts by weight of the resultant capsulated toner, 0.35 parts by weight of a fine powder of a hydrophobic silica "Aerosil R-972" (manufactured by Japan Aerosil Co., Lid.) was added to obtain the capsulated toner of this embodiment.

The toner was packed into the EP cartridge under the same conditions with Example 1-1, and subjected to a one-month shelf test at 50° C. (to ensure the shelf stability under the limit), and checked for a presence or absence of deposit of the toner on the surface of the developing blade and the surface of the developing roller at a contact area of both the blade and the roller.

Results are shown in FIG. 5.

No deposit of toner was observed on the developing blade and the surface of the developing roller in contact with the developing blade. After the shelf test, the EP cartridge packed with the toner was used with the LED Printer OKI MIKROLINE 16n to carry out the initial printing. Neither abnormal printing at the pitches derived from perimeters of the developing roller or the photoreceptor drum, nor fog were observed, to obtain the printed matter with good printing quality accompanying enough density and resolution.

After this, running printing of 30,000 prints was performed with A4 size under PRINTING DYUTY 15%.

Printing quality of the printed matters at the end of running was as good as the initial printing, which provided printed matter of extremely high quality.

Then, FIG. 6 shows the observation of fluidity of toner remaining in the EP cartridge at the end of running. The test performed in this example showed no change in fluidity from the initial printing, and maintaining superior powder fluidity.

Example 1-3

The capsulated toner was prepared in following manner.

The following mixture was put into an attritor ("MA-01SC" manufactured by Mitsui Miike Engineering Corp.) and dispersed at 15° C. for 10 hours, to prepare a polymerizable composition.

Component of Mixture:

| | |
|---|---|
| Styrene: | 70 parts by weight |
| n-butyl acrylate: | 30 parts by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printex L" manufactured by Degusa Co. Ltd.) | 7 parts by weight |
| 2,2'-Azo bis-isobutyronitrile | 1 part by weight |

Eight parts by weight of polyacrylate and 0.35 part by weight of divinylbenzen were dissolved in 180 parts by weight of ethanol. 600 parts by weight of distilled water was added to the mixture to prepare a dispersion medium for polymerization. The polymerizable composition was added to the dispersion medium and dispersed at 15° C. for 10 minutes at a rate of 8,000 r.p.m in a TK homomixer ("M Type" manufactured by Tokusyu Kika Kogyo Co., Ltd.).

Next, the resultant dispersion was put into a separable-one litter flask and reacted at 85° C. for 12 hours under a nitrogen flow while stirring at a rate of 100 r.p.m. The dispersoid obtained by polymerization of the polymerizable composition in these steps is referred to as an "intermediate particle".

Then, 9 parts by weight of aqueous emulsion B obtained under Example 1-2 was dropped in the aqueous suspension of the intermediate particles to swell the particles. Just after dropping, observing the aqueous suspension by an optical microscope, no droplet of the emulsion was visible. It was therefore confirmed that the swelling had occurred for a very short time. The suspension was further reacted as the second polymerization at 85° C. for 10 hours under a nitrogen atmosphere with stirring.

After cooling the reaction mixture, the dispersion medium was dissolved with a 0.5 N aqueous hydrochloride acid solution and the mixture was filtrated. The residue thus obtained was washed with water, air-dried, dried at 40° C.

for 10 hours under a reduced pressure of 10 mmHg and classified by air classifier to obtain a capsulated toner having an average particle diameter of 7 μm.

A Tg of the resin particle obtained before the seed polymerization was 40° C. It means that a core of the capsulated toner obtained in this example has a Tg of 40° C.

To 50 parts by weight of the resultant capsulated toner, 0.35 parts by weight of a fine powder of a hydrophobic silica "Aerosil R-972" (manufactured by Japan Aerosil Co., Lid.) was added to obtain the capsulated toner of the embodiment.

The toner was packed into the EP cartridge under the same conditions as Example 1-1, and subjected to a one-month shelf test at 50° C. (assuming to ensure the shelf stability under the limit), and checked for the presence or absence of deposit of the toner on the surface of the developing blade and the surface of the developing roller at contact areas of both the blade and the roller.

Results are shown in FIG. 5.

No deposit of toner was observed on the developing blade and the surface of the developing roller in contact with the developing blade. After the shelf test, the EP cartridge packed with the toner was used with the LED Printer OKI MIKROLINE 16n to carry out the initial printing. Neither abnormal printing at the pitches derived from perimeters of the developing roller or the photoreceptor drum, nor fog were observed, to obtain the printed matter with good printing quality having enough density and resolution.

After this, running printing of 30,000 prints was performed with A4 size under PRINTING DYUTY 15%.

Printing quality of the printed matter at the end of running was as good as initial printing, which provided the printed matter of extremely high quality.

Then, FIG. 6 showed the observation of fluidity of toner remaining in the EP cartridge at the end of running. The test performed in this example showed no change in fluidity from initial printing, and maintaining superior powder fluidity.

Comparative Example 1-1

According to the same manner of Example 1-1, 8.5 parts by weight of methyl methacrylate, 1.5 part by weight of n-butyl acrylate, 0.5 part by weight of 2,2'-azo bis-isobutyronitrile, 0.1 part by weight of sodium laurylsulfate, and 80 parts by weight of water were mixed to the aqueous suspension of intermediate particle obtained in Example 1-1, and the mixture was treated by ultrasonic generator ("US-150", Nippon Seiki Industry Co., Ltd.) to prepare aqueous emulsion C.

A Tg of the thermoplastic resin obtained in the polymerization of aqueous emulsion C alone was 70° C. It means that the resin derived from shell has a Tg of 70° C.

The toner was packed into the EP cartridge under the same conditions as Example 1-1, and subjected to a one-month shelf test at 50° C., and checked for the presence or absence of deposits of the toner on the surface of the developing blade and the surface of the developing roller at contact areas of both the blade and the roller.

Results are shown in FIG. 5.

Deposits of toner were observed on the developing blade and the surface of the developing roller contacting with the developing blade, and horizontal white streaks at the interval of the developing roller cycle were observed on the surface of the printed matter. Vertical white streaks were also observed of the surface of the printed matter.

It is found that the area where the toner layer was not form due to toner deposits on the developing blade caused these streaks.

A one-month shelf test at 50° C. (to ensure the shelf stability under the limit) under the conditions that provides the toner layer of the present invention 60 μm in thickness was performed, and checked for the presence or absence of deposits of the toner on the surface of the developing blade at contact areas of the developing blade and the developing roller, and the surface of the developing roller.

Under these conditions, no toner deposits were observed on the developing blade and the surface of the developing roller in contact with the developing blade as is the case of Example 1-1.

Yet under these conditions, background fog of the printed matter was very strong, and half-tone was fair; thus printing quality was poor. Fog on the photoreceptor drum was 20% at this time.

Example and Comparative Example on Embodiment 2

Example 2-1

In the imaging apparatus described in FIG. 1 and FIG. 2, the pushing-pressure from the developing roller toward the photoreceptor drum was adjusted at 10 g/mm.

Also, the toners having capsular structure were prepared according to the method mentioned below.

The following mixture was put into an attritor ("MA-01SC" manufactured by Mitsui Miike Engineering Corp.) and dispersed at 15 □ for 10 hours, to prepare a polymerizable composition. Component of mixture:

| | |
|---|---|
| Styrene: | 77.5 parts by weight |
| n-butyl acrylate: | 22.5 parts by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printex L" manufactured by Degusa Co. Ltd.) | 7 parts by weight |
| 2,2'-Azo bis-isobutyronitrile | 1 part by weight |

Eight parts by weight of polyacrylate and 0.35 part by weight of divinylbenzen were dissolved in 180 parts by weight of ethanol. 600 parts by weight of distilled water was added to the mixture to prepare a dispersion medium for polymerization. The polymerizable composition was added to the dispersion medium and dispersed at 15° C. for 10 minutes at a rate of 8,000 r.p.m in a TK homomixer ("M Type" manufactured by Tokusyu Kika Kogyo Co., Ltd.). The resultant dispersion was put into a separable-one litter flask and reacted at 85° C. for 12 hours under a nitrogen flow while stirring at a rate of 100 r.p.m. The dispersoid obtained by polymerization of the polymerizable composition in these steps is referred to as "intermediate particle".

Next, 9.25 parts by weight of methyl methacrylate, 0.75 part by weight of n-butyl acrylate, 0.5 part by weight of 2,2'-azo bis-isobutyronitrile, 0.1 part by weight of sodium laurylsulfate, and 80 parts by weight of water were mixed into the aqueous suspension of the intermediate particle, and the mixture was treated by ultrasonic generator ("US-150", Nippon Seiki Industry Co., Ltd.) to prepare aqueous emulsion A. Nine parts by weight of aqueous emulsion A were dropped into the aqueous suspension of the intermediate particles to swell the particles. Just after dropping, observing the aqueous suspension by an optical microscope, no droplet of the emulsion was visible. It was therefore confirmed that the swelling had occurred for a very short time.

The suspension was further reacted as the second polymerization at 85° C. for 10 hours under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hours under a reduced pressure of 10 mmHg and classified by air classifier to obtain a capsulated toner having an average particle diameter of 7 μm.

A Tg of the resin particle obtained before the seed polymerization was 55° C. It means that a core of the capsulated toner obtained in this example has a Tg of 55° C.

The thermoplastic resin obtained by polymerization of aqueous emulsion A alone has a Tg of 85° C. It means that a shell of the capsulated toner obtained in this example has a Tg of 85° C.

To 50 parts by weight of the resultant capsulated toner, 0.35 parts by weight of a fine powder of a hydrophobic silica "Aerosil R-972" (manufactured by Japan Aerosil Co., Lid.) was added to obtain the capsulated toner of the embodiment.

The toner was packed into the EP cartridge, and subjected to a one-month shelf test at 50° C. (to ensure the shelf stability under the limit), and checked for the presence or absence of deposits on the surface of the photoreceptor drum at contact area of the photoreceptor drum and the developing roller, and the surface of the developing roller.

Results are shown in FIG. 9.

No deposits of toner were observed on the photoreceptor drum and the surface of the developing roller in contact with the photoreceptor drum. After the shelf test, the EP cartridge packed with the toner was used with the LED Printer OKI MIKROLINE 16n to print the initial printing. Neither abnormal printing at the pitches derived from perimeters of the developing roller or the photoreceptor drum nor fog were observed, to obtain the printed matter with good printing quality having enough density and resolution.

After this, running printing of 30,000 prints was performed with A4 size under PRINTING DYUTY 15%.

Printing quality of the printed matter at the end of running was as good as the initial printing, which provided the printed matter of extremely high quality.

Then, FIG. 10 showed the observation of fluidity of toner remaining in the EP cartridge at the end of running. The test performed in this example showed no change in fluidity from the initial printing, and maintaining superior powder fluidity.

Example 2-2

The capsulated toner was prepared the same way as Example 2-1, except that preparing the aqueous emulsion B by varying composition ratio of aqueous emulsion A in Example 2-1.

That is, 8.75 parts by weight of methyl methacrylate, 1.25 part by weight of n-butyl acrylate, 0.5 part by weight of 2,2'-azo bis-isobutyronitrile, 0.1 part by weight of sodium laurylsulfate, and 80 parts by weight of water were mixed to the aqueous suspension of the intermediate particle obtained in Example 2-1, and the mixture was treated by ultrasonic generator ("US-150", Nippon Seiki Industry Co., Ltd.) to prepare aqueous emulsion B. Nine parts by weight of aqueous emulsion B was dropped to the aqueous suspension of the intermediate particles to swell the particles. Just after dropping, observing the aqueous suspension by an optical microscope, no droplet of the emulsion was visible. It was therefore confirmed that the swelling had occurred for a very short time.

The suspension was further reacted as the second polymerization at 85° C. for 10 hours under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hours under a reduced pressure of 10 mmHg and classified by air classifier to obtain a capsulated toner having an average particle diameter of 7 μm.

A Tg of the thermoplastic resin obtained in the polymerization of aqueous emulsion B alone was 75. It means that the resin derived from shell has a Tg of 75° C.

To 50 parts by weight of the resultant capsulated toner, 0.35 parts by weight of a fine powder of a hydrophobic silica "Aerosil R-972" (manufactured by Japan Aerosil Co., Lid.) was added to obtain the capsulated toner of the embodiment.

The toner was packed into the EP cartridge under the same conditions as Example 2-1, and subjected to a one-month shelf test at 50° C. (to ensure the shelf stability under the limit), and checked for the presence or absence of deposits of the toner on the surface of the photoreceptor drum at contact areas of the photoreceptor drum and the developing roller, and the surface of the developing roller.

Results are shown in FIG. 9.

No deposits of toner were observed on the photoreceptor drum and the surface of the developing roller in contact with the photoreceptor drum. After the shelf test, the EP cartridge packed with the toner was used with the LED Printer OKI MIKROLINE 16n to carry out the initial printing. Neither abnormal printing at the pitches derived from perimeters of the developing roller or the photoreceptor drum, nor fog were observed, to obtain the printed matter with good printing quality accompanying enough density and resolution.

After this, running printing of 30,000 prints was performed with A4 size under PRINTING DYUTY 15%.

Printing quality of the printed matters at the end of running was as good as the initial printing, which provided the printed matter of extremely high quality.

Then, FIG. 10 showed the observation of fluidity of toner remaining in the EP cartridge at the end of running. The test performed in this example showed no change in fluidity from the initial printing, and maintaining superior powder fluidity.

Example 2-3

The capsulated toner was prepared with following manner.

The following mixture was put into an attritor ("MA-01SC" manufactured by Mitsui Miike Engineering Corp.) and dispersed at 15 □ for 10 hours, to prepare a polymerizable composition.

Component of Mixture:

| | |
|---|---|
| Styrene: | 70 parts by weight |
| n-butyl acrylate: | 30 parts by weight |
| Low molecular weight polyethylene: (used as an offset preventing agent) | 1.5 part by weight |
| Electrostatic preventing agent: ("Aizensupiro black TRH" manufactured by Hodogaya Chemical Corp.) | 1 part by weight |
| Carbon black ("Printex L" manufactured by Degusa Co. Ltd.) | 7 parts by weight |
| 2,2'-Azo bis-isobutyronitrile | 1 part by weight |

Eight parts by weight of polyacrylate and 0.35 part by weight of divinylbenzen were dissolved in 180 parts by weight of ethanol. 600 Parts by weight of distilled water was added to the mixture to prepare a dispersion medium for polymerization. The polymerizable composition was added to the dispersion medium and dispersed at 15 □ for 10 minutes at a rate of 8,000 r.p.m in a TK homomixer ("M Type" manufactured by Tokusyu Kika Kogyo Co., Ltd.). Next, the resultant dispersion was put into a separable-one litter flask and reacted at 85° C. for 12 hours under a nitrogen flow while stirring at a rate of 100 r.p.m. The dispersoid obtained by polymerization of the polymerizable composition in these steps is referred to as "intermediate particle".

Then, 9 parts by weight of aqueous emulsion B obtained under Example 2-2 were dropped to the aqueous suspension of the intermediate particles to swell the particles. Just after dropping, observing the aqueous suspension by an optical microscope, no droplet of the emulsion was visible. It was therefore confirmed that the swelling had occurred for a very short time. The suspension was further reacted as the second polymerization at 85° C. for 10 hours under a nitrogen atmosphere with stirring. After cooling the reaction mixture, the dispersion medium was dissolved with a 0.5 N aqueous hydrochloride acid solution and the mixture was filtrated. The residue thus obtained was washed with water, air-dried, dried at 40° C. for 10 hours under a reduced pressure of 10 mmHg and classified by air classifier to obtain a capsulated toner having an average particle diameter of 7 $\mu$m.

A Tg of the resin particle obtained before the seed polymerization was 40° C. It means that a core of the capsulated toner obtained in this example has a Tg of 40° C.

To 50 parts by weight of the resultant capsulated toner, 0.35 parts by weight of a fine powder of a hydrophobic silica "Aerosil R-972" (manufactured by Japan Aerosil Co., Lid.) was added to obtain the capsulated toner of the embodiment.

The toner was packed into the EP cartridge under the same conditions with Example 2-1, and subjected to a one-month shelf test at 50° C. (to ensure the shelf stability under the limit), and checked for the presence or absence of deposits of the toner on the surface of the photoreceptor drum at contact areas of the photoreceptor drum and the developing roller, and the surface of the developing roller.

Results are shown in FIG. 9.

No deposits of toner were observed on the photoreceptor drum and the surface of the developing roller in contact with the photoreceptor drum. After the shelf test, the EP cartridge packed with the toner was used with the LED Printer OKI MIKROLINE 16n to carry out the initial printing. Neither abnormal printing at the pitches derived from perimeters of the developing roller or the photoreceptor drum, nor fog were observed, to obtain the printed matter with good printing quality accompanying enough density and resolution.

After this, running printing of 30,000 prints was performed with A4 size under PRINTING DYUTY 15%.

Printing quality of the printed matter at the end of running was as good as the initial printing which provided the printed matter of extremely high quality.

Then, FIG. 10 showed the observation of fluidity of toner remaining in the EP cartridge at the end of running. The test performed in this example showed no change in fluidity from initial printing, and maintaining superior powder fluidity.

Comparative Example 2-1

According to the same manner of Example 2-1, 8.5 parts by weight of methyl methacrylate, 1.5 part by weight of n-butyl acrylate, 0.5 part by weight of 2,2'-azo bis-isobutyronitrile, 0.1 part by weight of sodium laurylsulfate, and 80 parts by weight of water were mixed to the aqueous suspension of the intermediate particle obtained in Example 2-1, and the mixture was treated by ultrasonic generator ("US-150", Nippon Seiki Industry Co., Ltd.) to prepare aqueous emulsion C.

A Tg of the thermoplastic resin obtained in the polymerization of aqueous emulsion C alone was 70° C. It means that the resin derived from shell has a Tg of 70° C.

The toner was packed into the EP cartridge under same conditions with Example 2-1, and subjected to a one-month shelf test at 50° C., and checked for the presence or absence of deposits of the toner on the surface of the photoreceptor drum at contact areas of the photoreceptor drum and the developing roller and the surface of the developing roller.

Results are shown in FIG. 9.

Deposits of toner were observed on the photoreceptor drum and the surface of the developing roller in contact with the photoreceptor drum, and horizontal white streaks at the interval of the developing roller cycle were observed on the surface of the printed matter.

When the same shelf test under the condition in which pushing-pressure of the toner on the photoreceptor drum was 0.5–1 g/mm was performed, there was no deposit on the surfaces of the photoreceptor drum and the developing roller in contact with the photoreceptor drum.

No horizontal streaks at the interval of the developing cycle or the photoreceptor drum cycle were observed on the printed matter.

As described repeatedly, however, under these conditions, fog on the photoreceptor drum was as much as 20–25%, then printing quality was inferior to Examples 2-1 to 2-3.

Example of the third Embodiment

Example 3-1

In this example, the fixation device 34 was adjusted for a surface temperature of the heat-roller 22 of 175° C., a printing speed of 200 mm/sec (30 ppm), and a diameter of the heat-roller 22 of 30 mm. Among the polymerization toner or each capsulated toner 25 shown in FIG. 2, a polymerization toner having monolayer structure without shell had a Tg of 55° C. or 65° C., a capsulated toner with a shell had a Tg of the core of 55° C. and a changeable Tg of the shell, then a pressure-dependency of fixation percentage $\eta$ thereof was measured.

Figure 14:
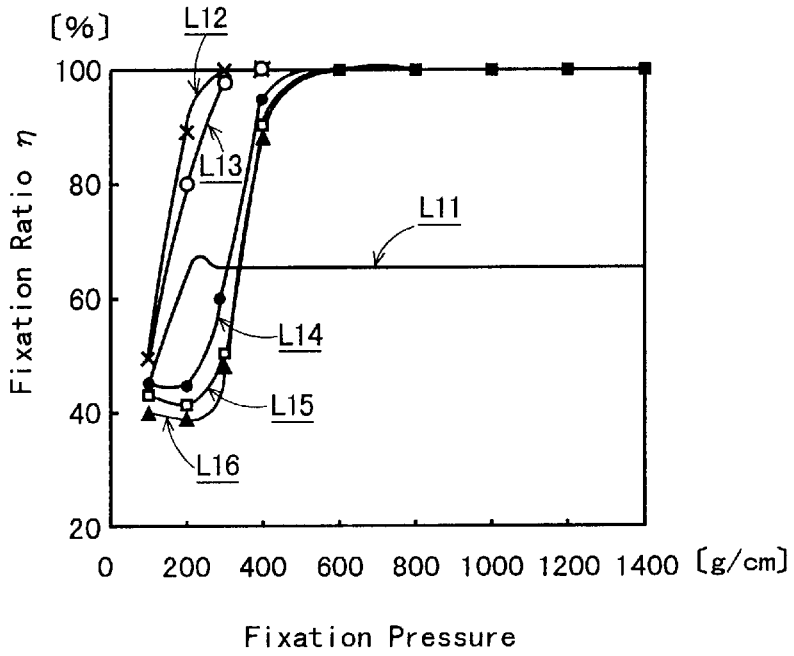
FIG. 14 shows the relationship of fixation pressure and fixation percentage of the Example 3-1.

FIG. 14 illustrates the relationship of fixation pressure and fixation percentage $\eta$ in the Example 3-1 of the present invention. In this figure, the horizontal axis is fixation pressure and the vertical axis is fixation percentage $\eta$.

In FIG. 14, L11 indicates a fixation percentage $\eta$ of polymerization toner having monolayer structure without shell having a Tg of 65° C., L12 indicated a fixation percentage $\eta$ of polymerization toner having a monolayer structure without shell having a Tg of 55° C., L13 indicates a fixation percentage $\eta$ of the capsulated toner 25 (FIG. 1) whose Tg of the shell was 65° C. and Tg of the core was 55° C., L14 indicates a fixation percentage $\eta$ of the capsulated toner 25 whose Tg of the shell was 75° C. and Tg of the core was 55° C., L15 indicates a fixation percentage $\eta$ of the capsulated toner 25 whose Tg of the shell was 85° C. and Tg of the core was 55° C., and L16 indicates a fixation percentage $\eta$ of the capsulated toner 25 whose Tg of the shell was 100° C. and Tg of the core was 55° C.

As shown in the figure, the polymerization toner having a monolayer structure without shell having a Tg of 55° C. and the capsulated toner 25 with the shell of a Tg of 65° C. could obtain a fixation percentage η of 95% or more when the fixation-pressure was adjusted above 200 g/cm, and more specifically, 200–1200 g/cm in linear load. On the other hand, the capsulated toner 25 with the shell of a Tg of 75° C. could obtain a practicable fixation percentage η of 95% or more, though fixation-pressure should be adjusted above 400 g/cm, that was twice as high as the lowest pressure, more specifically 400–1200 g/cm in linear load.

On the contrary, the polymerization toner having monolayer structure without shell having a Tg of 65° C. could not obtain 65% or more of a practicable fixation percentage η, no matter how much the fixation-pressure was increased.

In consideration of the test results of FIGS. 2 and 3, it is possible to increase a practicable fixation percentage η by elevation of the temperature of the fixation device.

Hence, a durability and a blocking resistance could be improved and a fixation percentage η could be elevated when the capsulated toner 25 having a Tg of 75–100° C. with the shell was used and a fixation pressure was ranged from 400 to 1200 g/cm in linear load.

Example 3-2

In this example, the fixation device 34 was adjusted for a surface temperature of the heat-roller 32 of 150° C., a printing speed of 100 mm/sec (15 ppm), and a diameter of the heat-roller 32 of 30 mm. A polymerization toner having monolayer structure without shell had a Tg of 55° C. or 65° C., a capsulated toner 25 with a shell had a Tg of the core of 55° C. and a changeable Tg of the shell, then pressure-dependency of fixation percentage η thereof was measured.

Figure 15:
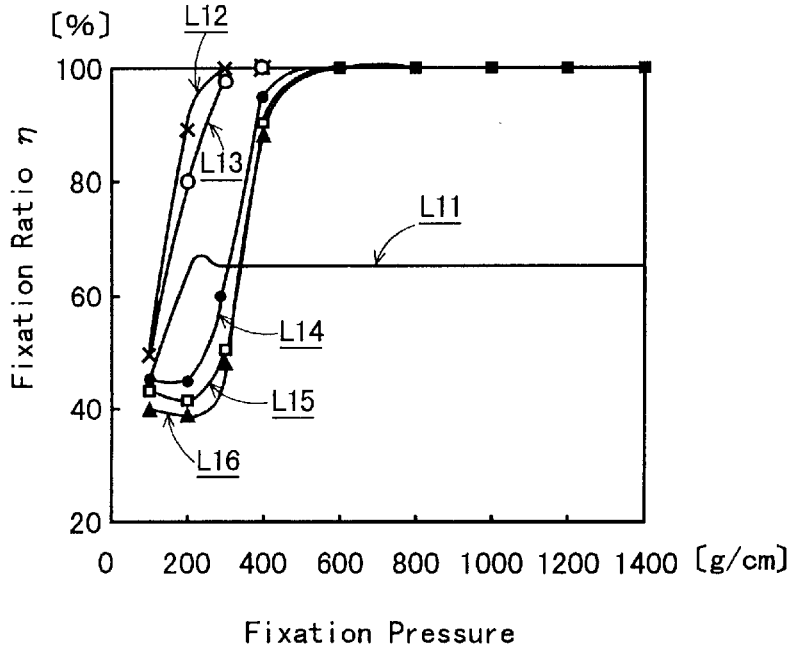
FIG. 15 shows the relationship of fixation pressure and fixation percentage of the Example 3-2.

FIG. 15 illustrates the relationship of fixation pressure and fixation percentage η in the Example 3-2 of the present invention. In this figure, the horizontal axis is fixation pressure and the vertical axis is fixation percentage η.

In FIG. 15, L11 indicates a fixation percentage η of polymerization toner having monolayer structure without shell having a Tg of 65 □, L12 indicates a fixation percentage η of polymerization toner having monolayer structure without shell having a Tg of 55° C., L13 indicates a fixation percentage η of the capsulated toner 25 (FIG. 1) whose Tg of the shell was 65° C. and Tg of the core was 55° C., L14 indicates a fixation percentage η of the capsulated toner 25 whose Tg of the shell was 75° C. and Tg of the core was 55° C., L15 indicates a fixation percentage η of the capsulated toner 25 whose Tg of the shell was 85° C. and Tg of the core was 55° C., and L16 indicates a fixation percentage η of the capsulated toner 25 whose Tg of the shell was 100° C. and Tg of the core was 55° C.

As shown in the figure, the polymerization toner having a monolayer structure without shell having a Tg of 55° C. and the capsulated toner 25 with the shell of a Tg of 65° C. could obtain a fixation percentage η of 95% or more when fixation-pressure was adjusted above 200 g/cm, and more specifically 200–1200 g/cm in linear load. On the other hand, the capsulated toner 25 with the shell having a Tg of 75° C. or more could obtain a practicable fixation percentage η of 95% or more, though fixation-pressure should be adjusted above 400 g/cm, that was twice as high as the lowest pressure, and more specifically 400–1200 g/cm in linear load.

On the contrary, the polymerization toner having monolayer structure without a shell having a Tg of 65° C. could not obtain 65% or more of a practicable fixation percentage η, no matter how increased fixation-pressure.

In consideration of the test results of FIGS. 2 and 3, it is possible to increase a fixation percentage η by elevation of the temperature of the fixation device.

Hence, a durability and a blocking resistance could be improved and a fixation percentage η could be increased when the capsulated toner 25 having a Tg of 75–100° C. with the shell was used and a fixation pressure was ranged from 400 to 1200 g/cm in linear load.

Example 3-3

In this example, the fixation device 34 was adjusted for a surface temperature of the heat-roller 32 of 155° C., a printing speed of 200 mm/sec (35 ppm), and a diameter of the heat-roller 32 of 30 mm. A polymerization toner having a monolayer structure without shell had a Tg of 35° C. or 65° C., a capsulated toner 25 with a shell had a Tg of the core of 35° C. and a changeable Tg of the shell, then pressure-dependency of fixation percentage η thereof was measured.

Figure 16:
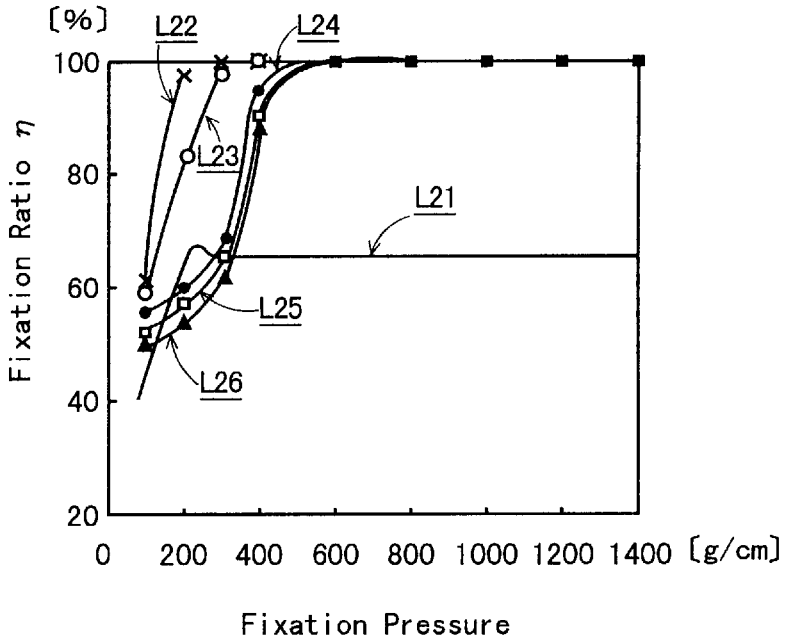
FIG. 16 shows the relationship of fixation pressure and fixation percentage of the Example 3-3.

FIG. 16 illustrates the relationship of fixation pressure and fixation percentage η in the Example 3-3 of the present invention. In this figure, the horizontal axis is fixation pressure and the vertical axis is fixation percentage η.

In FIG. 16, L21 indicates a fixation percentage η of polymerization toner having monolayer structure without shell having a Tg of 65° C., L22 indicates a fixation percentage η of polymerization toner having monolayer structure without shell having a Tg of 35° C., L23 indicates a fixation percentage η of the capsulated toner 25 (FIG. 1) whose Tg of the shell was 65° C. and Tg of the core was 35° C., L24 indicates a fixation percentage η of the capsulated toner 25 whose Tg of the shell was 75° C. and Tg of the core was 35° C., L25 indicates a fixation percentage η of the capsulated toner 25 whose Tg of the shell was 85° C. and Tg of the core was 35° C., and L26 indicates a fixation percentage η of the capsulated toner 25 whose Tg of the shell was 100° C. and Tg of the core was 35° C.

As shown in the figure, the polymerization toner having a monolayer structure without shell having a Tg of 35° C. and the capsulated toner 25 with the shell of a Tg of 65° C. could obtain a fixation percentage η of 95% or more when fixation-pressure was adjusted above 200 g/cm, and more specifically 200–1200 g/cm in linear load. On the other hand, the capsulated toner 25 with the shell having a Tg of 75° C. or more could obtain a practicable fixation percentage η of 95% or more, though fixation-pressure should be adjusted above 400 g/cm, that was twice as high as the lowest pressure, and more specifically 400–1200 g/cm in linear load.

On the contrary, the polymerization toner having monolayer structure without a shell having a Tg of 65° C. could not obtain a fixation percentage η of 65% or more, no matter how much the fixation pressure was increased.

In consideration of the test results of FIGS. 2 and 3, it is possible to increase a fixation percentage η by the elevation of the temperature of the fixation device.

Hence, a durability and a blocking resistance could be improved and a fixation percentage η could be increased when the capsulated toner 25 having a Tg of 75–100° C. with the shell was used and a fixation pressure was ranged from 400 to 1400 g/cm in linear load.

Example 3-4

In this example, the fixation device 34 was adjusted for a surface temperature of the heat-roller 32 of 135° C., a printing speed of 100 mm/sec (30 ppm), and a diameter of the heat-roller 32 of 30 mm. A polymerization toner having a monolayer structure without shell had a Tg of 35° C. or 65° C., a capsulated toner 25 with a shell had a Tg of the core of 35° C. and a changeable Tg of the shell, then pressure-dependency of fixation percentage η thereof was measured.

Figure 17:
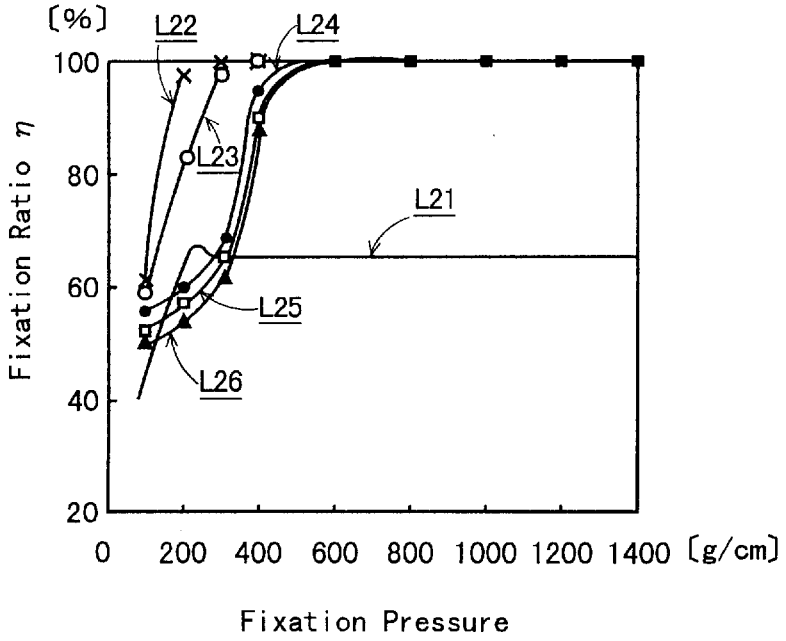
FIG. 17 shows the relationship of fixation pressure and fixation percentage of the Example 3-4.

FIG. 17 illustrates the relationship of fixation pressure and fixation percentage η in the Example 3-4 of the present invention. In this figure, the horizontal axis is fixation pressure and the vertical axis is fixation percentage η.

In FIG. 17, L21 indicates a fixation percentage η of polymerization toner having monolayer structure without shell having a Tg of 65° C., L22 indicates a fixation percentage η of polymerization toner having monolayer structure without shell having a Tg of 35° C., L23 indicates a fixation percentage η of the capsulated toner 25 (FIG. 11) whose Tg of the shell was 65° C. and Tg of the core was 35° C., L24 indicates a fixation percentage η of the capsulated toner 25 whose Tg of the shell was 75° C. and Tg of the core was 35° C., L25 indicates a fixation percentage η of the capsulated toner 25 whose Tg of the shell was 85° C. and Tg of the core was 35° C., and L26 indicates a fixation percentage η of the capsulated toner 25 whose Tg of the shell was 100° C. and Tg of the core was 35° C.

As shown in the figure, the polymerization toner having monolayer structure without a shell having a Tg of 35° C. and the capsulated toner 25 with the shell of a Tg of 65° C. could obtain a fixation percentage η of 95% or more when the fixation-pressure was adjusted above 200 g/cm, and more specifically 200–1200 g/cm in linear load. On the other hand, the capsulated toner 25 with the shell having a Tg of 75° C. could obtain a practicable fixation percentage η of 95% or more, though fixation-pressure should be adjusted above 400 g/cm that was twice as high as the lowest pressure, more specifically 400–1400 g/cm in linear load.

On the contrary, the polymerization toner having the monolayer structure without shell having a Tg of 65° C. could not obtain a fixation percentage η of 65% or more, no matter how increased fixation-pressure.

In consideration of the test results of FIGS. 2 and 3, it is possible to increase a fixation percentage η by the elevation of the temperature of the fixation device is adjusted higher.

Therefore, a durability and a blocking resistance could be improved and a fixation percentage η could be increased when the capsulated toner 25 having a Tg of 75–100° C. with the shell was used and a fixation pressure was ranged from 400 to 1400 g/cm in linear load.

Comparative Example 3-1

According to Example 3-1 above-mentioned, a relationship of pressure-dependency and fixation percentage η was examined under the same conditions except that a surface temperature of the heat-roller 32 was adjusted at 225° C. As the result of this, even the polymerization toner having monolayer structure without shell having a Tg of 65° C. could obtain a enough fixation percentage η of 65% or more.

Although, if a surface temperature of the heat-roller 32 was elevated such as 225° C., a temperature inside of the imaging apparatus becomes extremely high on continuous printing, resulting in the necessity of a placement of a large cooling device. Thus, it was apparent that it was not suitable for actual use.

Comparative Example 3-2

According to Example 3-2 above-mentioned, a relationship of pressure-dependency and fixation percentage η was examined under the same conditions except that a surface temperature of the heat-roller 32 was adjusted at 210° C. As the result of this, even the polymerization toner having monolayer structure without shell having a Tg of 65° C. could obtain a enough fixation percentage η of 95% or more.

Although, if a surface temperature of the heat-roller 32 was elevated such as 210° C., a temperature inside of the imaging apparatus becomes extremely high on continuous printing, resulting in the necessity of a placement of a large cooling device. Thus, it was apparent that it was not suitable for actual use.

The invention is not limited by embodiments above-mentioned, and may be modified based on the purpose of the present invention, and does not exclude them from the scope of the present invention.

What is claimed is:

1. An imaging apparatus, comprising:

a photoreceptor drum;

a developing roller rotating in contact with the photoreceptor drum so that toner particles disposed on an outer surface of the developing roller move directly from the developing roller to the photoreceptor drum;

a developing blade cooperating with said developing roller so as to form a toner layer with a thickness of 50 μm or less on the outer surface of said developing roller, wherein said developing roller controls a development of a toner image on said drum through the formation of the toner layer having the thickness of 50 μm or less, the photoreceptor drum transferring the toner image formed on an outer surface thereof by the controlled-development onto a medium; and a fixation device heat-treating and fixing the toner image transferred onto said medium; wherein the toner layer comprises a plurality of multi-layered capsulated toner particles, each comprising an outermost shell formed from a resin having a Tg of 75° C. or more, and a core within said shell having a Tg that is less than the Tg of said shell.

2. An imaging apparatus, comprising:

a photoreceptor drum;

a developing roller rotating in contact with the photoreceptor drum so that toner particles disposed on an outer surface of the developing roller move directly from the developing roller to the photoreceptor drum;

a developing blade cooperating with said developing roller so as to form a toner layer with a thickness of 50 μm or less on the outer surface of said developing roller, wherein said developing roller controls a development of a toner image on said drum through the formation of the toner layer having the thickness of 50 μm or less, the photoreceptor drum transferring the toner image formed on an outer surface thereof by the controlled-development onto a medium; and a fixation device heat-treating and fixing the toner image transferred onto said medium; wherein the toner layer comprises a plurality of multi-layered capsulated toner particles, each comprising an outermost shell formed from a resin having a Tg of 85° C. or more, and a core within said shell having a Tg that is less than the Tg of said shell.

3. An imaging apparatus, comprising:

a photoreceptor drum;

a developing roller rotating in contact with the photoreceptor drum at a pressure welding force between 2 g/mm and 30 g/mm so that toner particles disposed on an outer surface of the developing roller move directly from the developing roller to the photoreceptor drum;

a developing blade cooperating with said developing roller so as to form a toner layer with a thickness of 50 μm or less on the outer surface of said developing roller, wherein said developing roller controls a development of a toner image on said drum through the formation of the toner layer having the thickness of 50 μm or less, the photoreceptor drum transferring the toner image formed on an outer surface thereof by the controlled-development onto a medium; and a fixation device heat-treating and fixing the toner image transferred onto said medium; wherein the toner layer comprises a plurality of multi-layered capsulated toner particles, each comprising an outermost shell formed from a resin having a Tg of 75° C. or more, and a core within said shell having a Tg that is less than the Tg of said shell.

4. An imaging apparatus, comprising:

a photoreceptor drum;

a developing roller rotating in contact with the photoreceptor drum at a pressure welding force between 2 g/mm and 30 g/mm so that toner particles disposed on an outer surface of the developing roller move directly from the developing roller to the photoreceptor drum;

a developing blade cooperating with said developing roller so as to form a toner layer with a thickness of 50 μm or less on the outer surface of said developing roller, wherein said developing roller controls a development of a toner image on said drum through the formation of the toner layer having the thickness of 50 μm or less, the photoreceptor drum transferring the toner image formed on an outer surface thereof by the controlled-development onto a medium; and a fixation device heat-treating and fixing the toner image transferred onto said medium; wherein the toner layer comprises a plurality of multi-layered capsulated toner particles, each comprising an outermost shell formed from a resin having a Tg of 85° C. or more, and a core within said shell having a Tg that is less than the Tg of said shell.

5. An imaging apparatus, comprising:

a photoreceptor drum;

a developing roller rotating in contact with the photoreceptor drum;

a developing blade cooperating with said developing roller so as to form a toner layer with a thickness of 50 μm or less on an outer surface of said developing roller, wherein said developing roller controls a development of a toner image on said drum through the formation of the toner layer having the thickness of 50 μm or less, the photoreceptor drum transferring the toner image formed on an outer surface thereof by the controlled-development onto a medium; and a fixation device heat-treating and fixing the toner image transferred onto said medium, wherein a fixation-pressure is between 400 g/cm and 1400 g/cm in linear load; wherein the toner layer comprises a plurality of multi-layered capsulated toner particles, each comprising an outermost resin shell having a Tg between 75° C. and 100° C., and a core within said shell having a Tg that is less than the Tg of said shell.

* * * * *